US010749318B2

(12) United States Patent
Akimoto

(10) Patent No.: US 10,749,318 B2
(45) Date of Patent: Aug. 18, 2020

(54) IGNITION COIL FOR INTERNAL COMBUSTION ENGINE

(71) Applicant: DENSO CORPORATION, Kariya, Aichi-pref. (JP)

(72) Inventor: Katsunori Akimoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 23 days.

(21) Appl. No.: 16/197,431

(22) Filed: Nov. 21, 2018

(65) Prior Publication Data

US 2019/0165550 A1 May 30, 2019

(30) Foreign Application Priority Data

Nov. 24, 2017 (JP) ..... 2017-226217

(51) Int. Cl.

| | |
|---|---|
| ***H01T 13/44*** | (2006.01) |
| ***H01T 13/05*** | (2006.01) |
| ***F02P 3/04*** | (2006.01) |
| *F02P 3/02* | (2006.01) |
| *F02P 7/02* | (2006.01) |

(52) U.S. Cl.

CPC ..... *H01T 13/44* (2013.01); *F02P 3/04* (2013.01); *H01T 13/05* (2013.01); *F02P 3/02* (2013.01); *F02P 7/02* (2013.01)

(58) Field of Classification Search

CPC .. H01T 13/44; H01T 13/05; F02P 3/04; F02P 7/02; F02P 3/02

See application file for complete search history.

(56) References Cited

U.S. PATENT DOCUMENTS

| | | | | |
|---|---|---|---|---|
| 7,036,495 | B1 | 5/2006 | Shimizu | |
| 2017/0016422 | A1* | 1/2017 | Akimoto | H01F 38/12 |
| 2017/0040104 | A1* | 2/2017 | Akimoto | F02P 3/02 |
| 2017/0321648 | A1* | 11/2017 | Sano | H01F 38/12 |
| 2019/0165549 | A1 | 5/2019 | Akimoto | |

FOREIGN PATENT DOCUMENTS

| | | |
|---|---|---|
| JP | 2002-050528 | 2/2002 |
| JP | 2011-100758 | 5/2011 |
| JP | 2014-022602 | 2/2014 |
| JP | 2014-022603 | 2/2014 |
| JP | 2014-022604 | 2/2014 |
| JP | 2017-098462 | 6/2017 |

* cited by examiner

*Primary Examiner* — Joseph J Dallo

(74) *Attorney, Agent, or Firm* — Nixon & Vanderhye PC

(57) ABSTRACT

An ignition coil for internal combustion engines is provided which includes a primary coil, a secondary coil, a case, a closing member, and a filled resin. The case includes a case body and a high-voltage tower. The closing member is press fit in the high-voltage tower to close the inside of the high-voltage tower. The closing member includes a resinous cylinder, a high-voltage terminal firmly attached to the resinous cylinder, and a resistor fit in the high-voltage terminal. The high-voltage terminal is of a hollow cylindrical shape with a bottom and an upper opening. The closing member has an outer peripheral surface of the resinous cylinder press-fit in the high-voltage tower. This structure minimizes pressure exerted on the resistor and the high-voltage tower to secure a desired degree of durability of the resistor and the high-voltage tower.

10 Claims, 18 Drawing Sheets

IGNITION COIL FOR INTERNAL COMBUSTION ENGINE

CROSS REFERENCE TO RELATED DOCUMENT

The present application claims the benefit of priority of Japanese Patent Application No. 2017-226217 filed on Nov. 24, 2017, the disclosure of which is incorporated herein by reference.

BACKGROUND

1 Technical Field

This disclosure relates generally to an ignition coil for internal combustion engines.

2 Background Art

Japanese Patent First Publication No. 2006-269613 teaches an ignition coil for internal combustion engines which is equipped with a primary coil, a secondary coil magnetically connected to the primary coil, a resistor working to eliminate noise arising from electrical discharge in a spark plug, and a case. The case includes a case body in which the primary and secondary coils are disposed and a cylindrical high-voltage tower extending downward from the case body.

The high-voltage tower has a high-voltage output terminal press-fit therein. The high-voltage output terminal has formed in an upper end thereof a recess in which the resistor is press-fit.

The ignition coil, as taught in the above publication, has the whole of the high-voltage output terminal press-fit in the high-voltage tower. The resistor is, as described above, press-fit in the recess of the high-voltage output terminal. This may result in a risk that an excessive pressure is exerted by the high-voltage output terminal on both the resistor and the high-voltage tower, which leads to concern about a decrease in durability of the resistor and the high-voltage tower.

SUMMARY

It is an object of this disclosure to provide an ignition coil for internal combustion engines which is configured to reduce pressure acting on a resistor and a high-voltage tower.

According to one aspect of this disclosure, there is provided an ignition coil for an internal combustion engine which comprises: (a) a primary coil and a secondary coil which are magnetically coupled with each other; (b) a case which includes a case body in which the primary and secondary coils are disposed and a high-voltage tower which is of a hollow cylindrical shape and extends downward from the case body; (c) a closing member which is press-fit in the high-voltage tower to close an inside of the high-voltage tower; and (d) a filled resin which is disposed inside the case body and hermetically seals the primary and secondary coils.

The closing member includes a resinous cylinder, a high-voltage terminal, and a resistor. The high-voltage terminal is firmly attached to the resinous cylinder and of a hollow cylindrical shape with a bottom and an upper opening facing upward. The resistor is disposed in the high-voltage tower The closing member is pressed at an outer peripheral surface of the resinous cylinder against the high-voltage tower.

The ignition coil, as described above, has the closing member which is pressed at the outer periphery of the resinous cylinder against the high-voltage tower, thereby minimizing direct exertion of the pressure, as produced by the press-fit of the closing member in the high-voltage tower, on the high-voltage terminal and the resistor. This enables the outer pressure surface of the resinous cylinder press-fit in the high-voltage tower to have a length increased in the vertical direction, which results in an increase in area of the outer peripheral surface placed in contact with the high-voltage tower. The outer peripheral surface of the resinous cylinder which has an increased area is, therefore, capable of bearing the pressure exerted by the high-voltage tower on the resinous cylinder, thereby ensuring a desired mechanical strength of the high-voltage tower and the resinous cylinder. Further, the increased area of the outer peripheral surface press-fit in the high-voltage tower enhances the degree of hermetical sealing between the high-voltage tower and the resinous cylinder, thereby minimizing the leakage of the filled resin from the case.

The resinous cylinder lies between the high-voltage terminal and the high-voltage tower, thereby eliminating the need for excessively increase the durability of the closing member made up of the resinous cylinder, the high-voltage terminal, and the resistor, which minimizes a risk that an undesirable high pressure is exerted by the closing member on the high-voltage tower.

As apparent from the above discussion, the ignition coil for internal combustion engines is capable of reducing the pressure exerted on the resistor and the high-voltage tower.

In this disclosure, symbols in brackets represent correspondence relation between terms in claims and terms described in embodiments which will be discussed later, but are not limited only to parts referred to in the disclosure.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Embodiments will be described below with reference to the drawings.

First Embodiment

The ignition coil 1 for internal combustion engines according to the first embodiment will be described below with reference to FIGS. 1 to 6.

Figure 1:
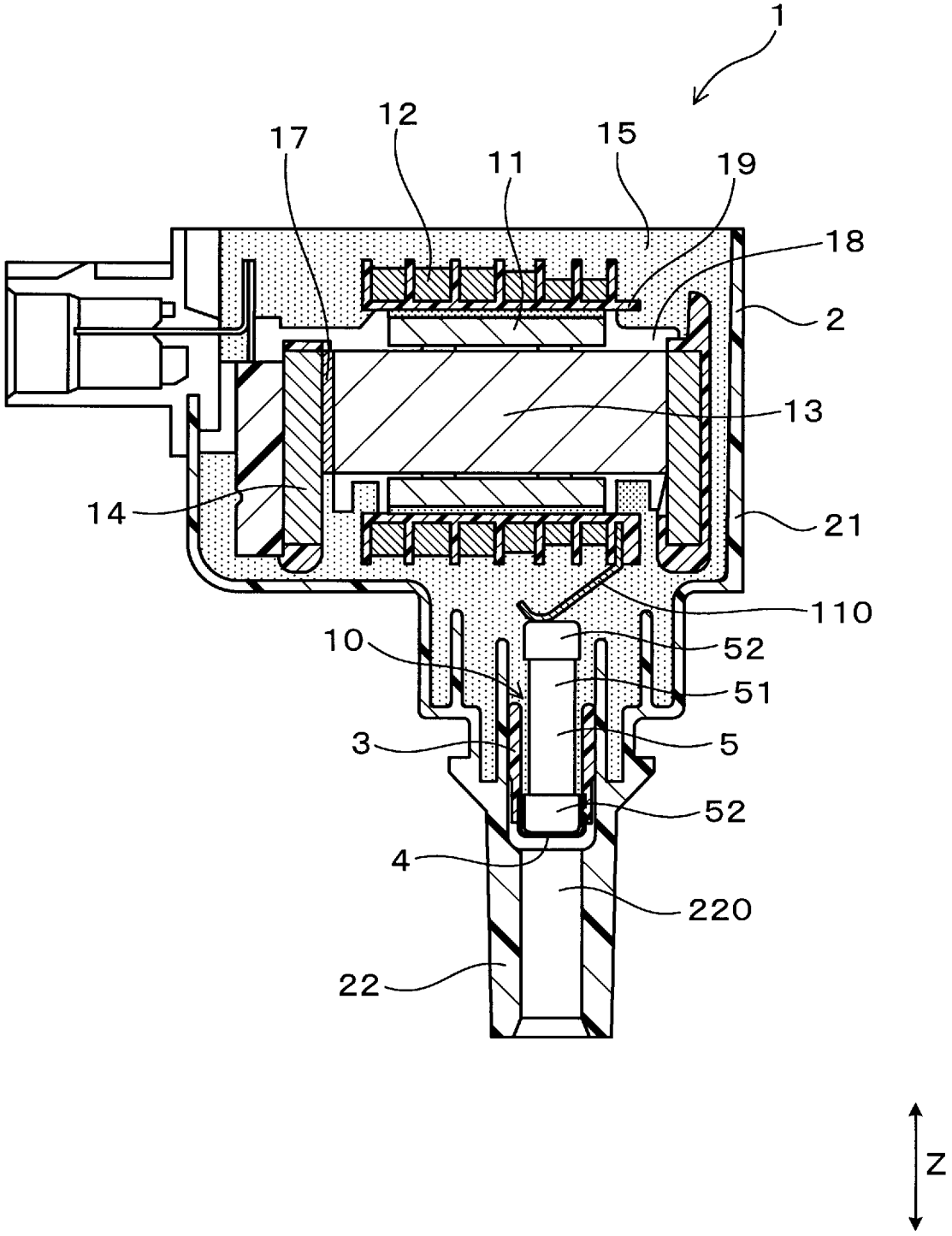
FIG. 1 is a sectional view which illustrates an ignition coil for internal combustion engines according to the first embodiment.

The ignition coil 1, as clearly illustrated in FIG. 1, includes the primary coil 11, the secondary coil 12, the case 2, the closing member 10, and the filled resin 15. The primary coil 11 and the secondary coil 12 are magnetically coupled together. The case 2 includes the case body 21 in which the primary coil 11 and the secondary coil 12 are disposed and the hollow cylindrical high-voltage tower 22 protruding or extending downward from the case body 21. The closing member 10 is press-fit in the high-voltage tower 22 to close the inside of the high-voltage tower 22. The filled resin 15 is disposed in the case body 21 and hermetically seal the primary coil 11 and the secondary coil 12.

The closing member 10 includes the resinous cylinder 3, the high-voltage terminal 4, and the resistor 5. The resinous cylinder 3 is made from resin and has a hollow cylindrical shape. The high-voltage terminal 4 is firmly attached to the resinous cylinder 3. The high-voltage terminal 4 is of a hollow cylindrical shape with a bottom and has an upper opening facing upward. The resistor 5 is fit in the high-voltage terminal 4. The closing member 10 is pressed at an outer peripheral surface of the resinous cylinder 3 against the high-voltage tower 22. In other words, the outer peripheral surface of the resinous cylinder 3 is press-fit on the inner peripheral surface of the high-voltage tower 22.

The outer peripheral surface of the resinous cylinder 3, as clearly illustrated in FIG. 2, has the resinous outer surface 311 (which will also be referred to below as an outer pressure surface) placed in pressed contact with the high-voltage tower 22. The resinous outer surface 311 occupies an area of the outer peripheral surface of the resinous cylinder 3 expanding in the vertical direction Z (i.e., a longitudinal direction) of the closing member 10. The outer peripheral surface of the resinous cylinder 3 also has the resinous outer surface 312 (which will also be referred to below as an outer non-pressed surface) which occupies another area of the outer peripheral surface of the resinous cylinder 3 and is not pressed against or placed in non-pressed contact with the high-voltage tower 22. In other words, the outer non-pressed surface 312 is located away from or adjacent the high-voltage tower 22 in the vertical direction Z. The outer non-pressed surface 312 occupies a portion of the outer peripheral surface of the resinous cylinder 3 which is unoccupied by the outer pressure surface 311 in the vertical direction Z.

Figure 2:
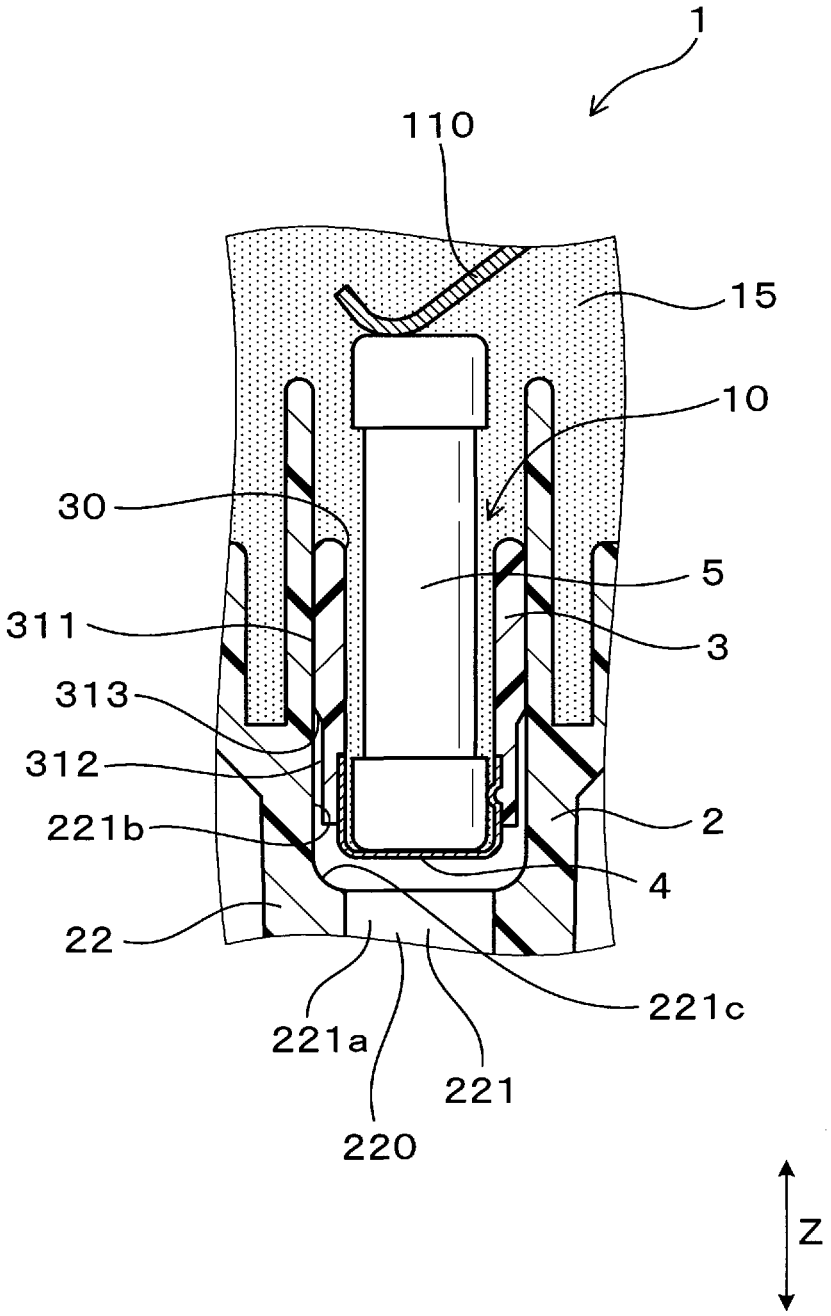
FIG. 2 is an enlarged view which illustrates a region around a resistor of the ignition coil in FIG. 1.

The high-voltage terminal 4 is, as clearly illustrated in FIG. 2, disposed inside a portion of the resinous cylinder 3 which has the outer non-pressed surface 312 in a direction substantially perpendicular to the vertical direction Z (i.e., the radial direction of the resinous cylinder 3).

The structure of the ignition coil 1 will be described below in detail.

In this disclosure, the vertical direction Z is a direction in which the high-voltage tower 22 protrudes from the case body 21. A region where the high-voltage tower 22 protrudes from the case body 21 in the vertical direction Z will also be referred to below as a lower side. The opposite side will also be referred to below as an upper side. "upper" or "lower" is used for the sake of convenience and not limited to orientation of the ignition coil 1 relative to the vertical direction.

In use, the ignition coil 1 is connected to a spark plug mounted in an internal combustion engine for automotive vehicles or cogeneration systems and works to apply high-voltage to the spark plug.

The primary coil 11 and the secondary coil 12 are, as can be seen in FIG. 1, arranged coaxially with each other. The primary coil 11 is disposed inside the secondary coil 12 in a radial direction thereof. Component parts of the ignition coil 1, such as the primary coil 11, the secondary coil 12, the center core 13, and the outer core 14, are hermetically sealed by the filled resin 15 in the case body 21. The filled resin 15 is made from epoxy resin.

The component parts of the ignition coil 1, as illustrated in FIG. 1, include the center core 13, the outer core 14, the igniter 16, the magnet 17, the primary bobbin 18, and the secondary bobbin 19. The center core 13 is arranged inside the primary coil 11 and the secondary coil 12 and made from soft magnetic material. The outer core 14 surrounds the primary coil 11 and the secondary coil 12 in a direction perpendicular to the vertical direction Z and is made from soft magnetic material. The igniter 16 works to electrically energize or deenergize the primary coil 11. The magnet 17 applies a magnetic bias to the center core 13 in order to enhance an output voltage from the ignition coil 1 and increases a change in magnetic flux upon deenergization of the primary coil 11 to increase voltage developed at the secondary coil 12. The primary bobbin 18 has the primary coil 11 wound therearound and is made from resin. The secondary bobbin 19 has the secondary coil 12 wound therearound and is made from resin.

The case 2 is made of PBT (Poly Butylene Terephtalate) resin. The case body 21 opens upward, so that an upper surface of the filled resin 15 disposed inside the case 2 is exposed upward outside the case body 21.

The high-voltage tower 22 is, as clearly illustrated in FIGS. 1 and 2, of a hollow cylindrical shape and has the through hole 220 extending therethrough in the vertical direction Z. The high-voltage tower 22, as illustrated in FIG. 2, has the inner peripheral surface 221 formed therein. The inner peripheral surface 221 includes portions which are arranged in the vertical direction Z and different in inner diameter from each other. The inner peripheral surface 221 of the high-voltage tower 22 includes the lower inner tower surface 221*a* and the upper inner tower surface 221*b*. The lower inner tower surface 221*a* is aligned with and arranged below the upper inner tower surface 221*b* in the vertical direction Z. The upper inner tower surface 221*b* is greater in inner diameter than the lower inner tower surface 221*a*. The inner peripheral surface 221 of the high-voltage tower 22 also includes the inner tower shoulder 221*c* lying between the lower inner tower surface 221*a* and the upper inner tower surface 221*b*.

Figure 3:
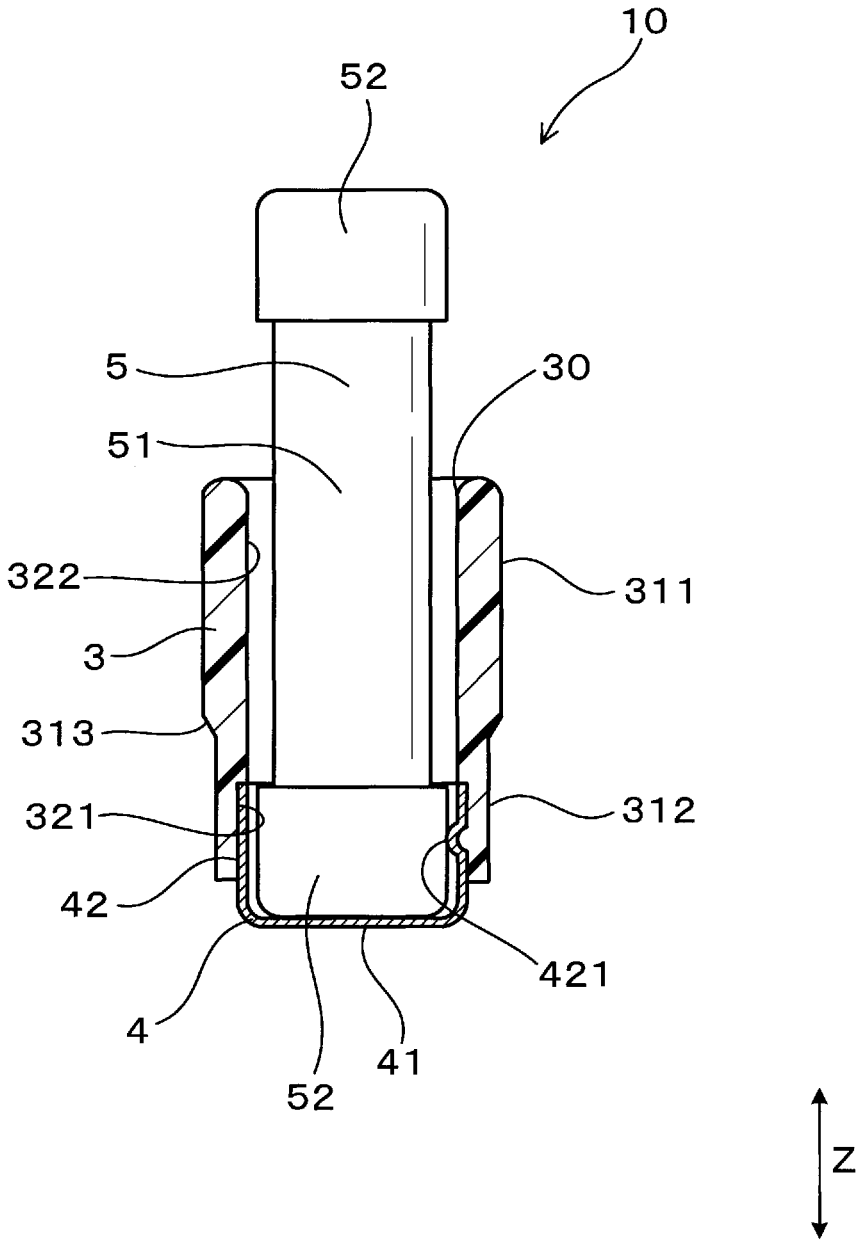
FIG. 3 is a partially sectional view which illustrates a closing member made up of a resinous cylinder, a high-voltage terminal, and a resistor in the first embodiment.

The closing member 10 made up of the resinous cylinder 3, the high-voltage terminal 4, and the resistor 5 is, as can be seen in FIG. 2, press-fit on the upper inner tower surface 221*b* of the high-voltage tower 22. The closing member 10 is, as demonstrated in FIG. 5, made by inserting the high-voltage terminal 4 in a mould, and injecting material to form the resinous cylinder 3, and, as shown in FIG. 3, fitting the resistor 5 into the high-voltage terminal 4. The closing member 10 is, as clearly illustrated in FIG. 2, press-fit in the high-voltage tower 22, thereby closing the through-hole 220 of the high-voltage tower 22. The closing member 10 serves as a stopper or plug to block the filled resin 15 from leaking downward from the high-voltage tower 22.

The outer peripheral surface of the resinous cylinder 3, as illustrated in FIGS. 2 and 3, has the outer pressure surface 311 extending upward from the middle portion thereof in the vertical direction Z. The outer peripheral surface of the resinous cylinder 3 also has the outer non-pressed surface 312 extending downward from the outer pressure surface 311. The outer non-pressed surface 312 is located away from the inner wall of the through-hole 220 of the high-voltage tower 22 in the radial direction with a gap therebetween. The outer pressure surface 311 is greater in diameter than the outer non-pressed surface 312. The outer non-pressed surface 312 has an upper end portion shaped as the tapered outer surface 313 which has a diameter increasing upward.

The corner 30 between the upper end surface and the inner peripheral surface of the resinous cylinder 3 is, as illustrated in FIGS. 2 and 3, shaped to facilitate insertion of the resistor 5 into the resinous cylinder 3 and the high-voltage terminal 4. Specifically, the upper end surface of the resinous cylinder 3 is curved or rounded in the form of a convex bulging upward. The corner 30 of the resinous cylinder 3 is curved smoothly so as to increase a diameter thereof upward.

Figure 5:
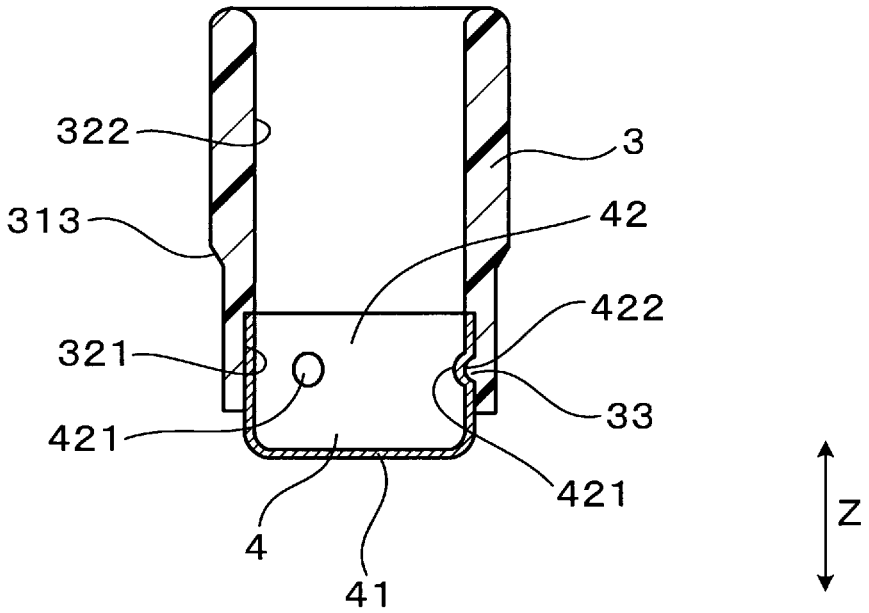
FIG. 5 is a sectional view which illustrates a resinous cylinder and a high-voltage terminal in the first embodiment.

The inner peripheral surface of the resinous cylinder 3, as illustrated in FIGS. 3 and 5, includes the large-diameter inner surface 321 and the small-diameter inner surface 322 which extends above the large-diameter inner surface 321 and is smaller in diameter than the large-diameter inner surface 321. The small-diameter inner surface 322 is located below the outer pressure surface 311 in the vertical direction Z. Specifically, the small-diameter inner surface 322 is located below the tapered outer surface 313 in the vertical direction Z.

The high-voltage terminal 4, as illustrated in FIGS. 3 and 5, has the outer peripheral surface thereof adhered close to the large-diameter inner surface 321 of the resinous cylinder 3. The high-voltage terminal 4 has the inner peripheral surface thereof lying flush with the small-diameter inner surface 322 of the resinous cylinder 3 in the vertical direction Z. The high-voltage terminal 4 has a portion extending downward from the resinous cylinder 3.

Figure 6:
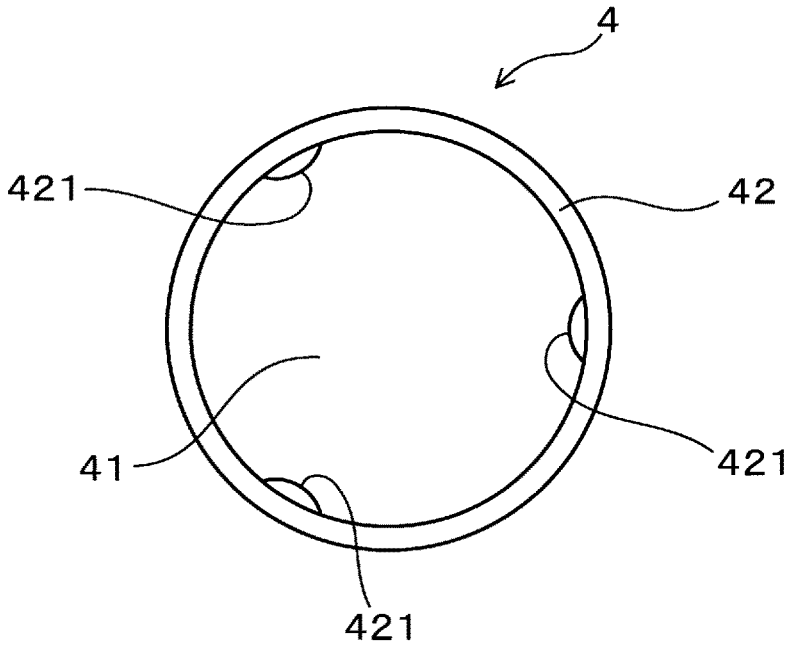
FIG. 6 is a plan view which illustrates a high-voltage terminal in the first embodiment.

The high-voltage terminal 4, as clearly illustrated in FIGS. 3, 5, and 6, includes the circular bottom wall 41 and the side wall 42 which is of a hollow cylindrical shape and extends upward from a circumferential edge of the circular bottom wall 41. The circular bottom wall 41 is, as illustrated in FIGS. 3 and 5, located below a lower end of the resinous cylinder 3.

Figure 4:
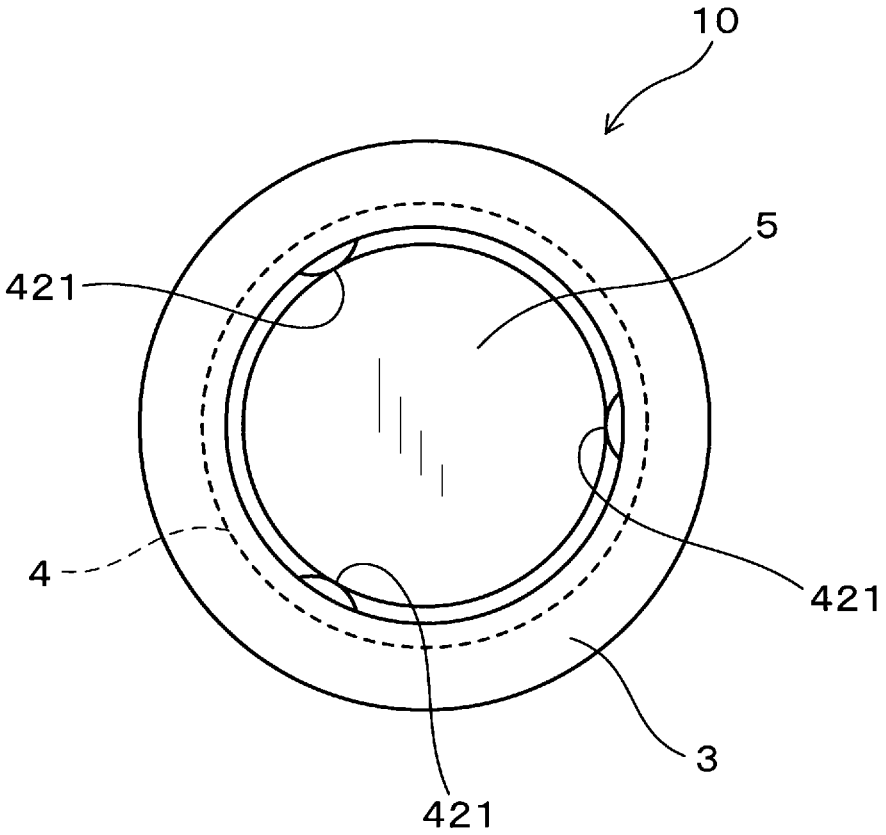
FIG. 4 is a plan view which illustrates a closing member in the first embodiment.

The high-voltage terminal 4, as illustrated in FIGS. 3 and 4, has a plurality of protrusions 421 formed on the inner peripheral surface of the side wall 42. The protrusions 421 bulge inward from the inner peripheral surface of the side wall 42 and are placed in contact with the outer peripheral surface of the resistor 5. Each of the inner protrusions 421 is of a semi-spherical shape in cross section. The inner protrusions 421 are, as can be seen in FIGS. 4 and 6, arranged away from each other in a circumferential direction of the high-voltage terminal 4. Specifically, the inner protrusions 421 are located at three places on the inner periphery of the high-voltage terminal 4 and at equal intervals away from each other in the circumferential direction of the high-voltage terminal 4. FIG. 4 represents the location of the outer periphery of the high-voltage terminal 4 using a broken line. The three inner protrusions 421 are, as partially illustrated in FIG. 5, located at the same level in the vertical direction Z. In other words, all the inner protrusions 421 line on a plane extending in a direction perpendicular to the vertical direction Z.

In a region in the vertical direction Z, as illustrated in FIG. 5, where the high-voltage terminal 4 and the resinous cylinder 3 are firmly attached to each other, in other words, the large-diameter inner surface 321 occupies the inner periphery of the resinous cylinder 3 in the vertical direction Z, the high-voltage terminal 4 has formed in the outer peripheral surface thereof a plurality of outer recesses 422 which have a depth in the inward direction of the high-voltage terminal 4 and in which portions of the resinous cylinder 3 are disposed. In other words, the outer recesses 422 lie inside an area of contact between the high-voltage terminal 4 and the resinous cylinder 3 in the radial direction of the high-voltage terminal 4 (i.e., the resinous cylinder 3). The outer recesses 422 are of a semi-spherical shape in cross section and smaller in size than the inner protrusions 421.

Specifically, the outer recesses 422 are located at three places in the outer periphery of the high-voltage terminal 4 and at equal intervals away from each other in the circumferential direction of the high-voltage terminal 4. The outer recesses 422 and the inner protrusions 421 are formed simultaneously using a press, so that each of the outer recesses 422 coincides with one of the inner protrusions 421 in the radial direction of the high-voltage terminal 4. The resinous cylinder 3 has formed on the large-diameter inner surface 321 a plurality of protrusions 33 fit in the outer recesses 422 of the high-voltage terminal 4. The protrusions 33 are formed by inserting the high-voltage terminal 4 into a mould and injecting raw resinous material into the mould to form the resinous cylinder 3, so that the resinous material flows into the outer recesses 422.

The resistor 5 is, as illustrated in FIG. 3, press-fitted in the high-voltage terminal 4, thereby pressing the resistor 5 against the three inner protrusions 421 of the high-voltage terminal 4.

The resistor 5, as illustrated in FIG. 3, includes the resistor body 51 and a pair of electrode caps 52 disposed on upper and lower ends of the resistor body 51. The resistor body 51 is formed by ceramic in a cylindrical shape, but may be designed in another configuration. For instance, the resistor body 51 may be made of a wire winding. The resistor body 51 is shaped to have an outer diameter kept constant in the vertical direction Z. The electrode caps 52 are each made by pressing a metallic plate into a cup shape. The resistor 5 has upper and lower end portions on which the electrode caps 52 are fit and which have an outer diameter greater than that of the remaining portion thereof.

The resistor 5 is, as illustrated in FIG. 3, press-fit at a lower one of the electrode caps 52 in the high-voltage terminal 4 so that it is pressed against all the inner protrusions 421 of the high-voltage terminal 4. The resistor 5 has an upper portion of a length thereof extending in the vertical direction Z which is above a middle portion of the length and exposed outside the resinous cylinder 3. In other words, an upper end of the resinous cylinder 3 which is opposed to a lower end thereof in the vertical direction Z is located near the middle portion of the length of the resistor 5 in the vertical direction Z.

The resistor body 51 of the resistor 5, as clearly illustrated in FIG. 2, has at least an entire outer periphery covered with the filled resin 15. In this embodiment, the whole of the outer periphery of the resistor 5 including the electrode caps 52 is covered with the filled resin 15.

The lower electrode cap 52 of the resistor 5 is electrically connected to a spark plug, not shown, through the high-voltage terminal 4. The upper electrode cap 52 of the resistor 5 is, as clearly illustrated in FIG. 1, electrically connected to the secondary coil 12 through the connector terminal 110. The resistor 5 works to minimize noise current flowing from the spark plug joined to the ignition coil 1.

The operation and beneficial advantages of this embodiment will be described below.

The ignition coil 1, as described above, has the closing member 10 which is pressed at the outer periphery of the resinous cylinder 3 against the high-voltage tower 22, thereby minimizing direct exertion of the pressure, as produced by the press-fit of the closing member 10 in the high-voltage tower 22, on the high-voltage terminal 4 and the resistor 5. This enables the outer pressure surface 311 of the resinous cylinder 3 press-fit in the high-voltage tower 22 to have a length increased in the vertical direction Z, which results in an increase in area of the outer pressure surface 311 placed in press-fit in the high-voltage tower 22. The outer pressure surface 311 which has an increased area is, therefore, capable of bearing the pressure exerted by the high-voltage tower 22 on the resinous cylinder 3, thereby ensuring a desired mechanical strength of the high-voltage tower 22 and the resinous cylinder 3.

Further, the increased area of the outer pressure surface 311 press-fit in the high-voltage tower 22 enhances the degree of hermetical sealing between the high-voltage tower 22 and the pressed outer surface 311 of the resinous cylinder 3, thereby minimizing the leakage of the filled resin 15 from the case 2.

The resinous cylinder 3 partially lies between the high-voltage terminal 4 and the high-voltage tower 22, thereby eliminating the need for excessively increase the durability of the closing member 10 made up of the resinous cylinder 3, the high-voltage terminal 4, and the resistor 5, which minimizes a risk that an undesirable high pressure is exerted by the closing member 10 on the high-voltage tower 22.

The outer peripheral surface of the resinous cylinder 3 includes the outer pressure surface 311 which is press-fit in a portion of the inner periphery of the high-voltage tower 22 in the vertical direction Z. The outer peripheral surface of the resinous cylinder 3 also includes the outer non-pressed surface 312 which is not press-fit in another portion of the inner periphery of the high-voltage tower 22 in the vertical direction Z. The high-voltage terminal 4 is, as described above, located inside a portion of the resinous cylinder 3 which has the outer non-pressed surface 312 in a direction perpendicular to the vertical direction Z. In other words, the high-voltage terminal 4 is not disposed inside the outer pressure surface 311 in the radial direction thereof, thereby eliminating the need for excessively increase the durability of the closing member 10 made up of the resinous cylinder 3, the high-voltage terminal 4, and the resistor 5 in a region where a portion of the closing member 10 has the outer pressure surface 311, which eliminates a risk that an undesirable high pressure is exerted by the outer pressure surface 311 on the high-voltage tower 22.

The high-voltage terminal 4, as described above, has the inner protrusions 421 formed on the inner periphery thereof. The inner protrusions 421 are placed in direct contact with the outer periphery of the resistor 5, thereby decreasing pressure required to press-fitting the resistor 5 into the high-voltage terminal 4 and ensuring the stability of electrical conductivity between the high-voltage terminal 4 and the resistor 5.

In a region in the vertical direction Z where the high-voltage terminal 4 and the resinous cylinder 3 are firmly attached to each other, the high-voltage terminal 4 has formed in the outer peripheral surface thereof the outer recesses 422 which have a depth in the inward direction of the high-voltage terminal 4. The resinous cylinder 3 is, therefore, partially disposed inside the outer recesses 422, thereby avoiding relative rotation of the resinous cylinder 3 and the high-voltage terminal 4 in the circumferential direction thereof.

As apparent from the above discussion, the ignition coil 1 in this embodiment is capable of decreasing pressure acting on the resistor 5 and the high-voltage tower 22.

Second Embodiment

Figure 7:
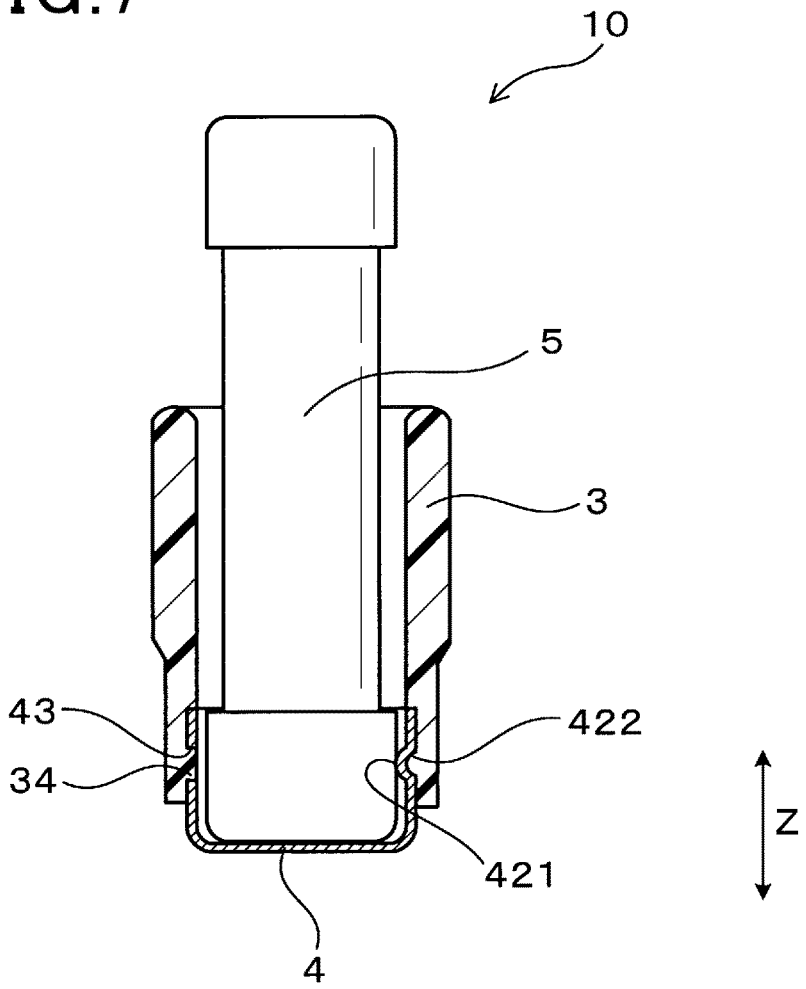
FIG. 7 is a partially sectional view which illustrates a closing member in the second embodiment.

FIG. 7 illustrates the closing member 10 according to the second embodiment.

The high-voltage terminal 4 has the holes 43 formed in the periphery thereof. The holes 43 extend through a thickness of the high-voltage terminal 4 in the radial direction of the high-voltage terminal 4 and lie in a region expanding in the vertical direction Z where the high-voltage terminal 4 and the resinous cylinder 3 are firmly attached to each other. In other words, the holes 43 face a contact of area between the high-voltage terminal 4 and the resinous cylinder 3 in the radial direction of the high-voltage terminal 4. The resinous cylinder 3 is partially disposed in the holes 43.

Figure 8:
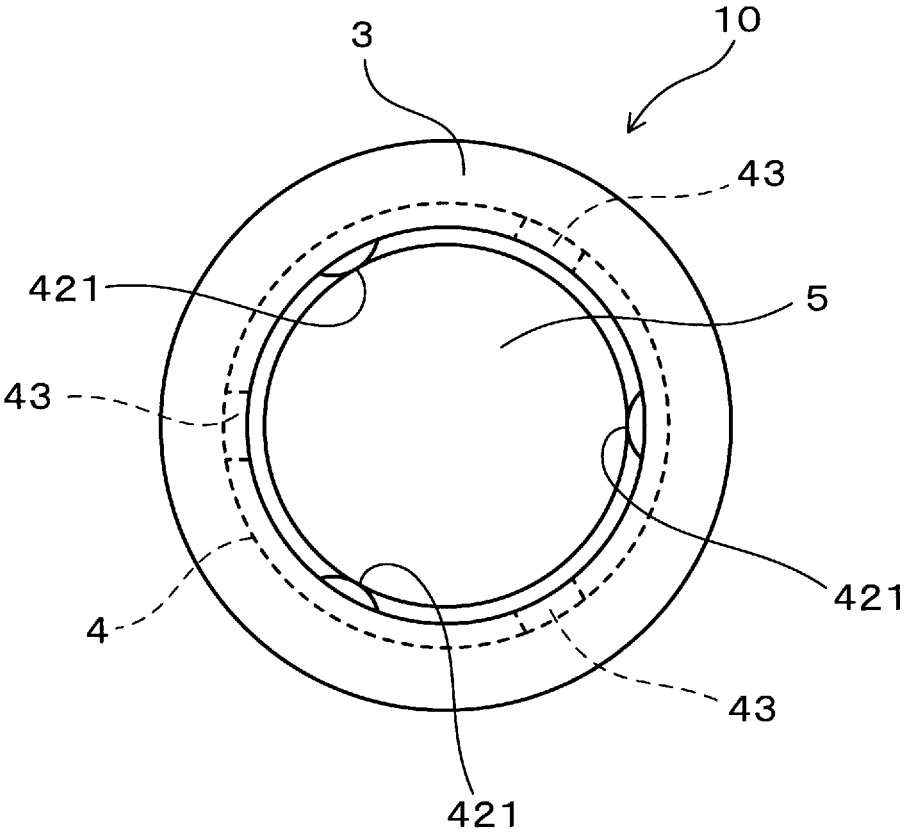
FIG. 8 is a plan view which illustrates a closing member in the second embodiment.

Specifically, the holes 43 are, as clearly illustrated in FIG. 8, arranged at three places in the inner periphery of the high-voltage terminal 4 and at equal intervals away from each other in the circumferential direction of the high-voltage terminal 4. All the holes 43 are arranged away from the inner protrusions 421 in the circumferential direction of the high-voltage terminal 4. Specifically, each of the holes 43 is disposed between adjacent two of the inner protrusions 421 in the circumferential direction of the high-voltage terminal 4. The holes 43 and the inner protrusions 421 are arranged at equal intervals away from each other in the circumferential direction of the high-voltage terminal 4. FIG. 8 represents the location of the outer periphery of the high-voltage terminal 4 and outlines of the holes 43 using broken lines.

Figure 9:
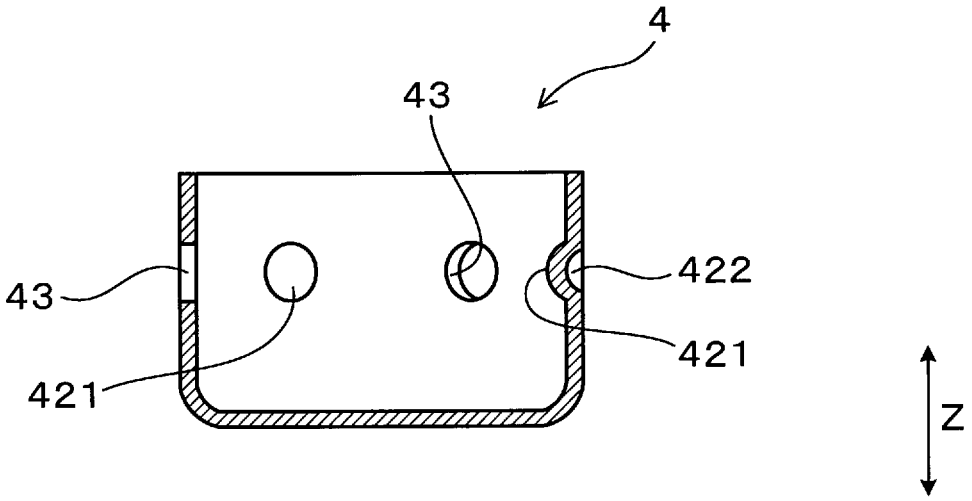
FIG. 9 is a sectional view which illustrates a high-voltage terminal in the second embodiment.

The three holes 43 are, as partially illustrated in FIG. 9, located at the same level in the vertical direction Z. In other words, all the holes 43 line on a plane extending in a direction perpendicular to the vertical direction Z. All the holes 43 and all the inner protrusions 421 lie on the same plane extending in a direction perpendicular to the vertical direction Z.

The resinous cylinder 3, as illustrated in FIG. 7, has formed on the inner periphery thereof the protrusions 34 each of which is disposed inside one of the holes 43. Each of the protrusions 34 has an inner end surface which faces in the radial direction of the resinous cylinder 3 and lies flush with the inner peripheral surface of the high-voltage terminal 4 in the vertical direction Z. The inner end surfaces of the protrusions 34 within the holes 43 are formed flush with the inner periphery of the high-voltage terminal 4 by contact of raw resinous material of the resinous cylinder 3 with a mould which is disposed inside the high-voltage terminal 4 for use in inserting the high-voltage terminal 4 into the mould and injecting the material into the mould to form the resinous cylinder 3. The high-voltage terminal 4, like in the first embodiment, has the outer recesses 422 formed in the outer periphery thereof.

Other arrangements are identical with those in the first embodiment.

In the second embodiment and following embodiments, the same or similar reference numbers as employed in the first or preceding embodiments refer to the same or similar parts unless otherwise specified.

The second embodiment offers substantially the same other beneficial advantages as those in the first embodiment.

Third Embodiment

Figure 10:
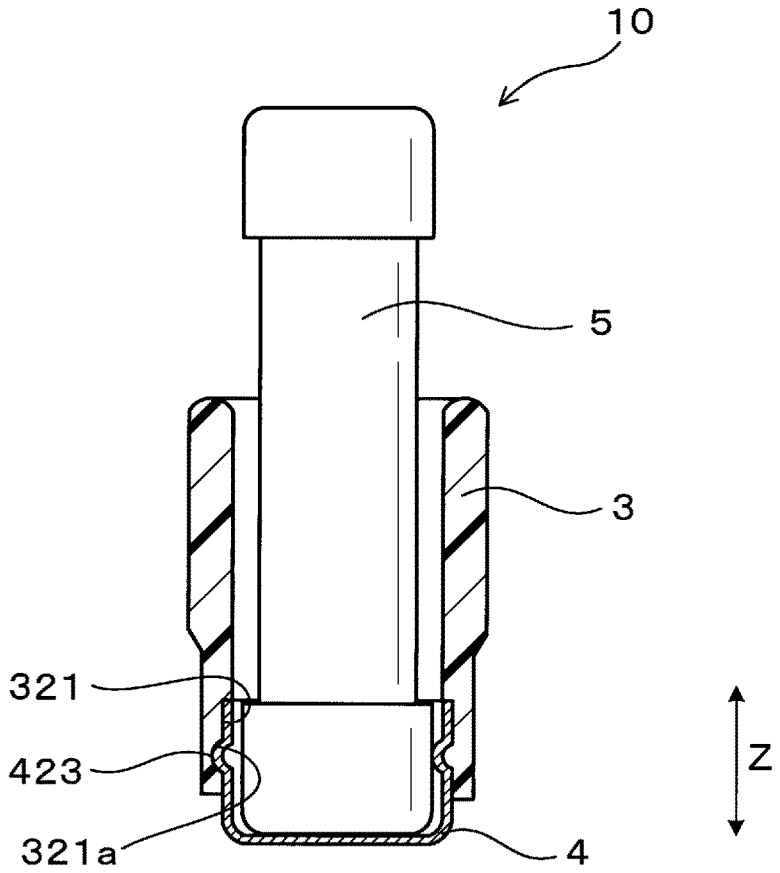
FIG. 10 is a partially sectional view which illustrates a closing member in the third embodiment.

FIG. 10 illustrates the closing member 10 according to the third embodiment.

In a region extending in the vertical direction Z where the high-voltage terminal 4 and the resinous cylinder 3 are firmly attached to each other, the high-voltage terminal 4 has formed on the outer periphery thereof the outer protrusions 423 which bulge outward into the inner periphery of the resinous cylinder 3 in the radial direction thereof.

The outer protrusions 423 are formed using a press. The outer protrusions 423 are of a semi-spherical shape in cross section. The resinous cylinder 3 has formed in the large-diameter inner surface 321 the recesses 321*a* firmly attached to the outer protrusions 423. The locations of the outer protrusions 423 of the high-voltage terminal 4 are the same as those of the holes 43 in the second embodiment illustrated in FIGS. 7 to 9.

Other arrangements are identical with those in the first embodiment.

The third embodiment offers substantially the same beneficial advantages as those in the first embodiment.

Fourth Embodiment

Figure 11:
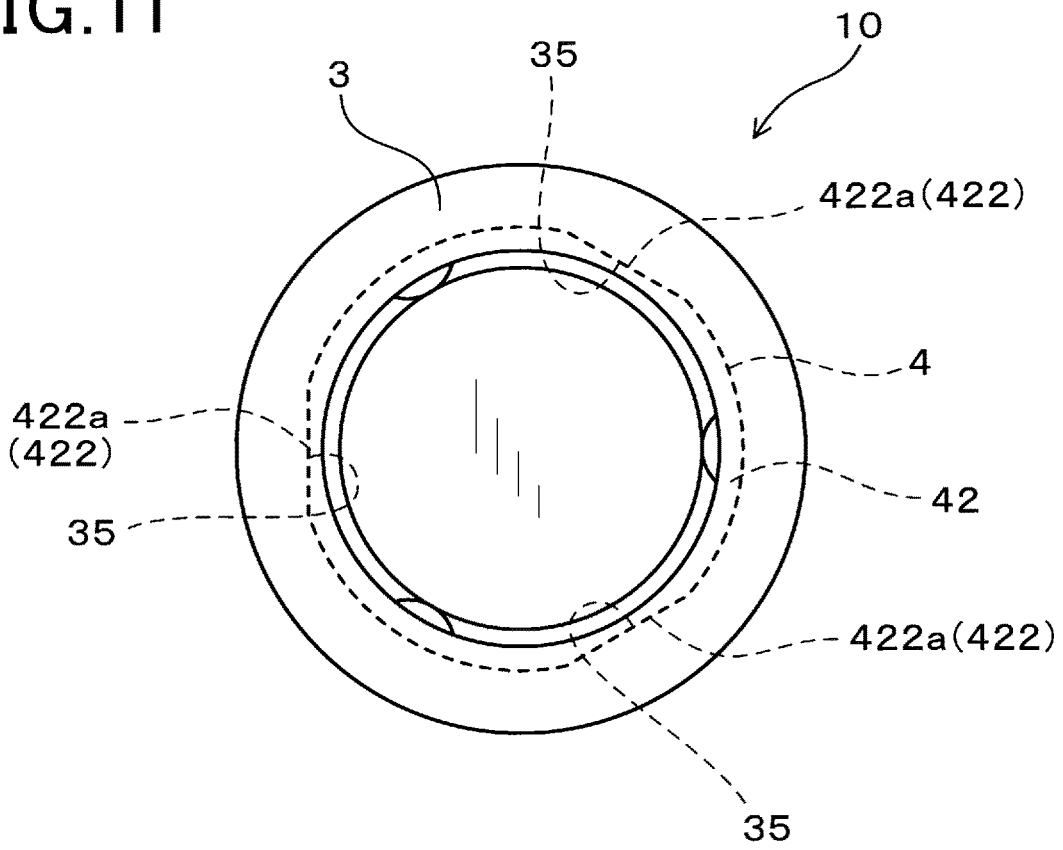
FIG. 11 is a plan view which illustrates a closing member in the fourth embodiment.
Figure 12:
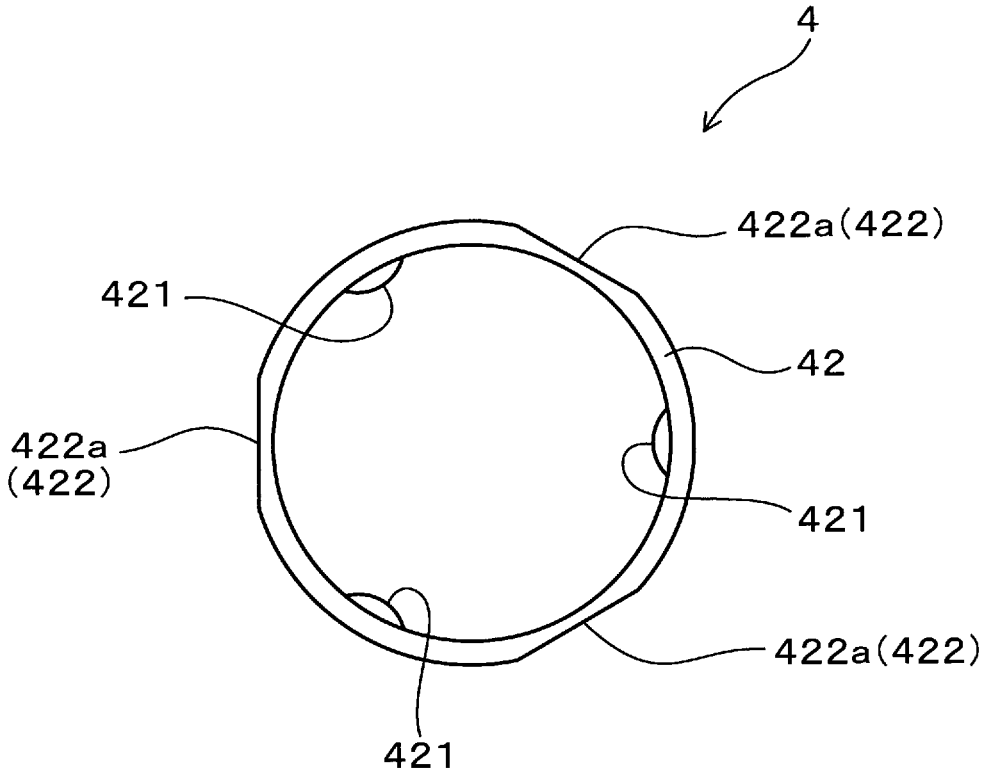
FIG. 12 is a plan view which illustrates a high-voltage terminal in the fourth embodiment.
Figure 13:
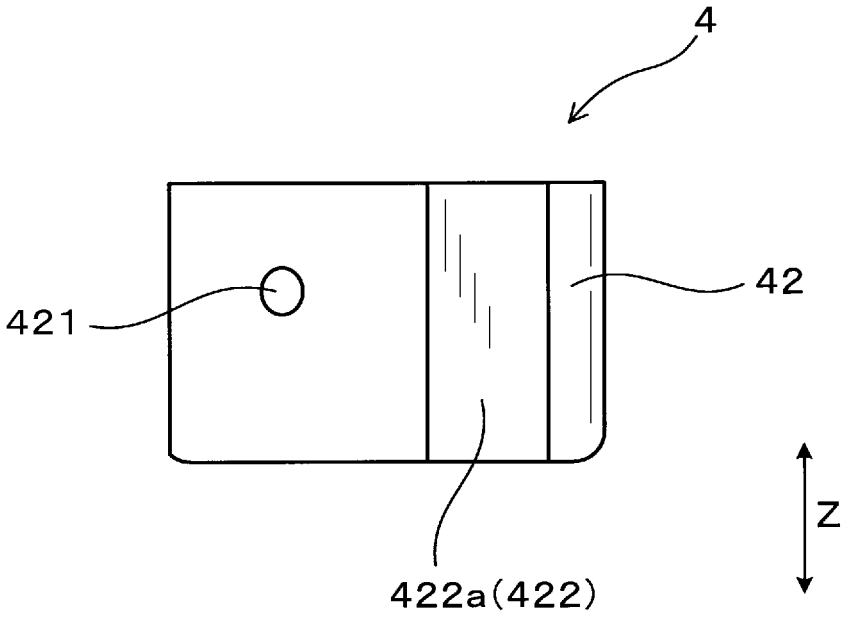
FIG. 13 is a side view which illustrates a high-voltage terminal in the fourth embodiment.

FIGS. 11 to 13 illustrate the closing member 10 according to the fourth embodiment.

The high-voltage terminal 4 has a plurality of flat surfaces 422*a* formed on the outer peripheral surface thereof. The flat surfaces 422*a* work like the outer recesses 422 in the first embodiment.

Specifically, the flat surfaces 422*a* are formed on the outer peripheral surface of the side wall 42 of the high-voltage terminal 4. Each of the flat surfaces 422*a* expands in a direction perpendicular to the radial direction of the high-voltage terminal 4.

In this embodiment, the flat surfaces 422*a* are formed at three places on the outer peripheral surface of the high-voltage terminal 4 and arranged at equal intervals away from each other in a circumferential direction of the high-voltage terminal 4. The locations of the flat surfaces 422*a* on the high-voltage surface 4 are the same as those of the holes 43 illustrated in FIGS. 7 to 9 in the second embodiment. Each of the flat surfaces 422*a*, as can be seen in FIG. 13, occupies the whole of the outer peripheral surface of the high-voltage terminal in the vertical direction Z. In other words, each of the flat surfaces 422*a* occupies an entire dimension of the high-voltage terminal 4 in the vertical direction Z. The flat surfaces 422*a* may be produced by cutting the surface of the cylindrical side wall 42.

The resinous cylinder 3, as clearly illustrated in FIG. 11, has the protrusions 35 formed on an inner peripheral surface 'i.e., an inner large-diameter surface) thereof. The protrusions 35 are each designed in a flat surface shape and placed in direct contact with, that is, firmly attached to the flat surfaces 422*a* of high-voltage terminal 4.

Other arrangements are identical with those in the first embodiment.

The fourth embodiment offers substantially the same beneficial advantages as those in the first embodiment.

Fifth Embodiment

Figure 14:
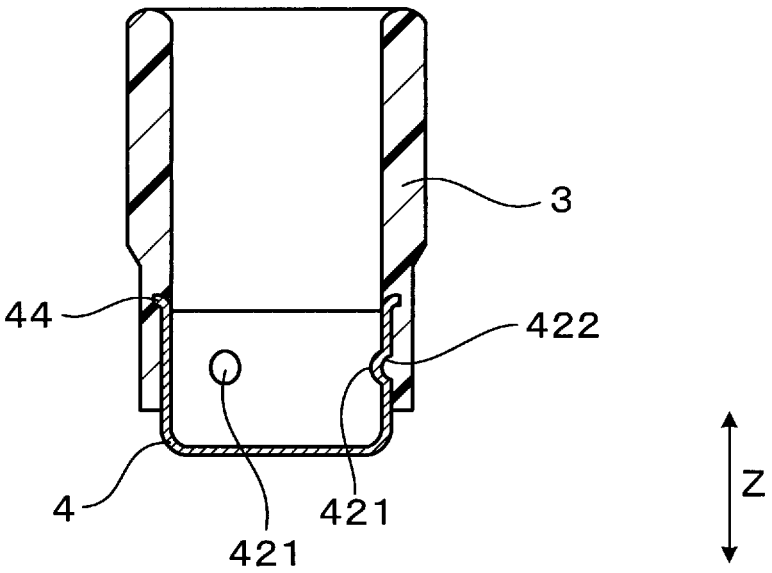
FIG. 14 is a sectional view which illustrates a resinous cylinder and a high-voltage terminal in the fifth embodiment.

FIG. 14 illustrates the high-voltage terminal 4 according to the fourth embodiment. The high-voltage terminal 4 has the flange 44 which is formed on an upper end thereof and extends outward in the radial direction of the high-voltage terminal 4.

The flange 44 has a diameter increasing outward as approaching the upper tip of the high-voltage terminal 4. The flange 44 occupies an entire circumference of the high-voltage terminal 4. The flange 44, as can be seen in FIG. 14, protrudes into the inner wall of the resinous cylinder 3.

FIGS. 15 to 19 demonstrate how to form the flange 44 of the high-voltage terminal 4.

Figure 15:
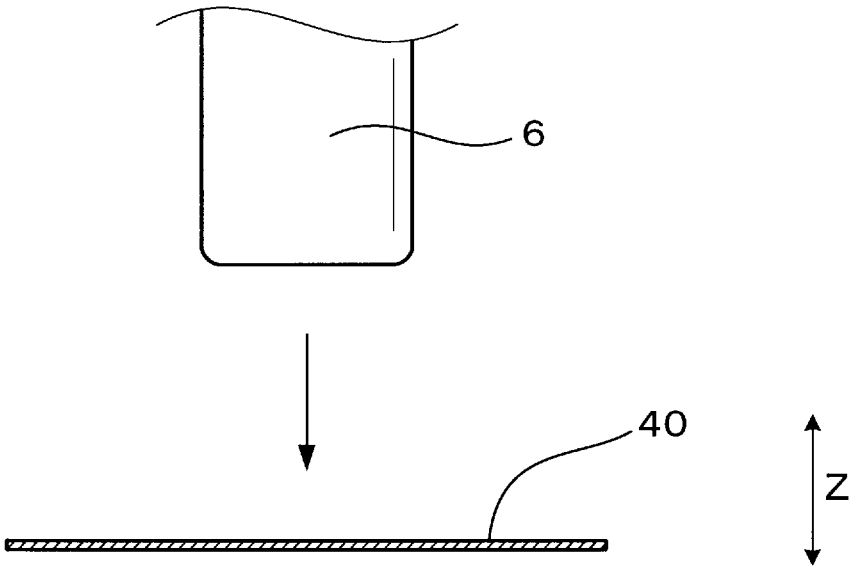
FIG. 15 is a partially sectional view which illustrates a flat plate before being pressed in the fifth embodiment.
Figure 16:
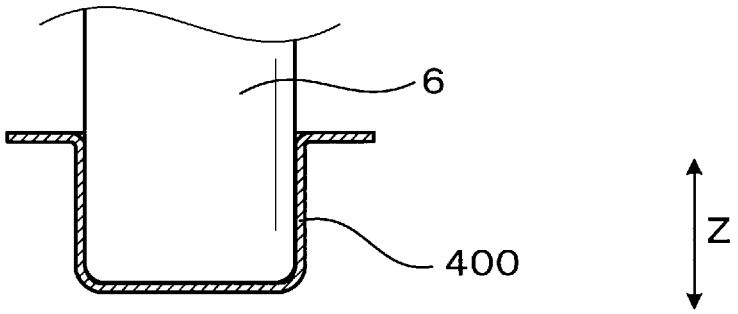
FIG. 16 is a partially sectional view which illustrates a flat plate pressed to form a cup in the fifth embodiment.

First, the flat plate 40 is, as illustrated in FIG. 15, prepared. The flat plate 40 is pressed using the punch 6 in the vertical direction Z that is a width-wise direction of the flat plate 40 to form the cup 400 illustrated in FIG. 16 in a drawing process. This causes the cup 400 to be shaped to have the edge 400*a* which is greater in size than the flange 44 of the high-voltage terminal 4 in the vertical direction Z.

Figure 17:
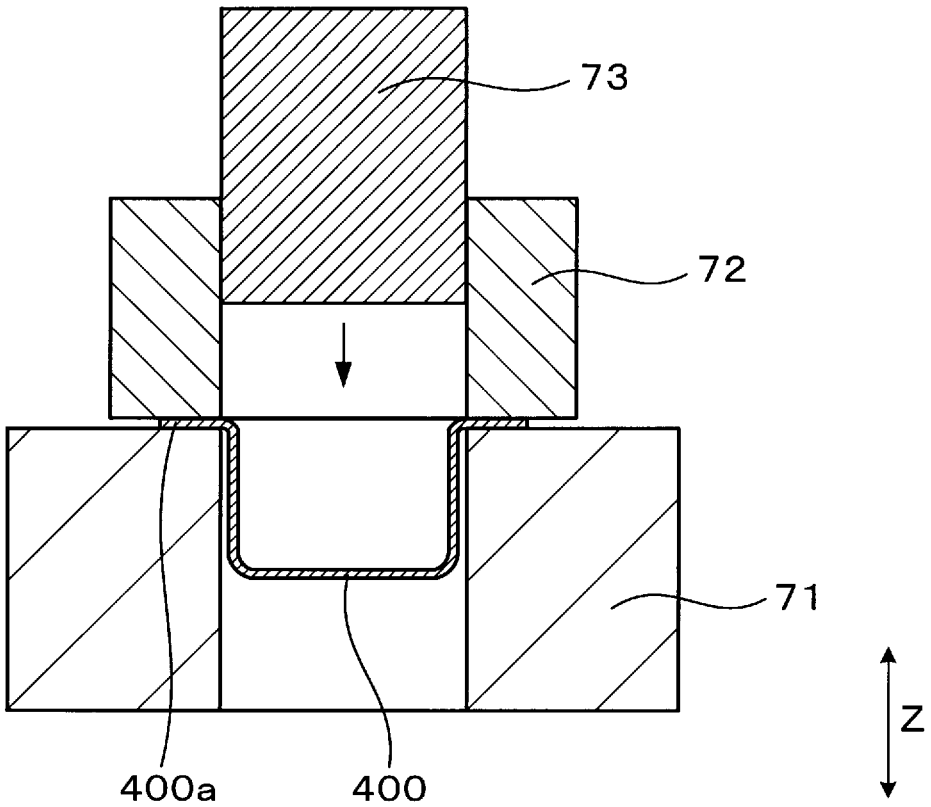
FIG. 17 is a sectional view which illustrates a cup with an end before being cut out in the fifth embodiment.
Figure 18:
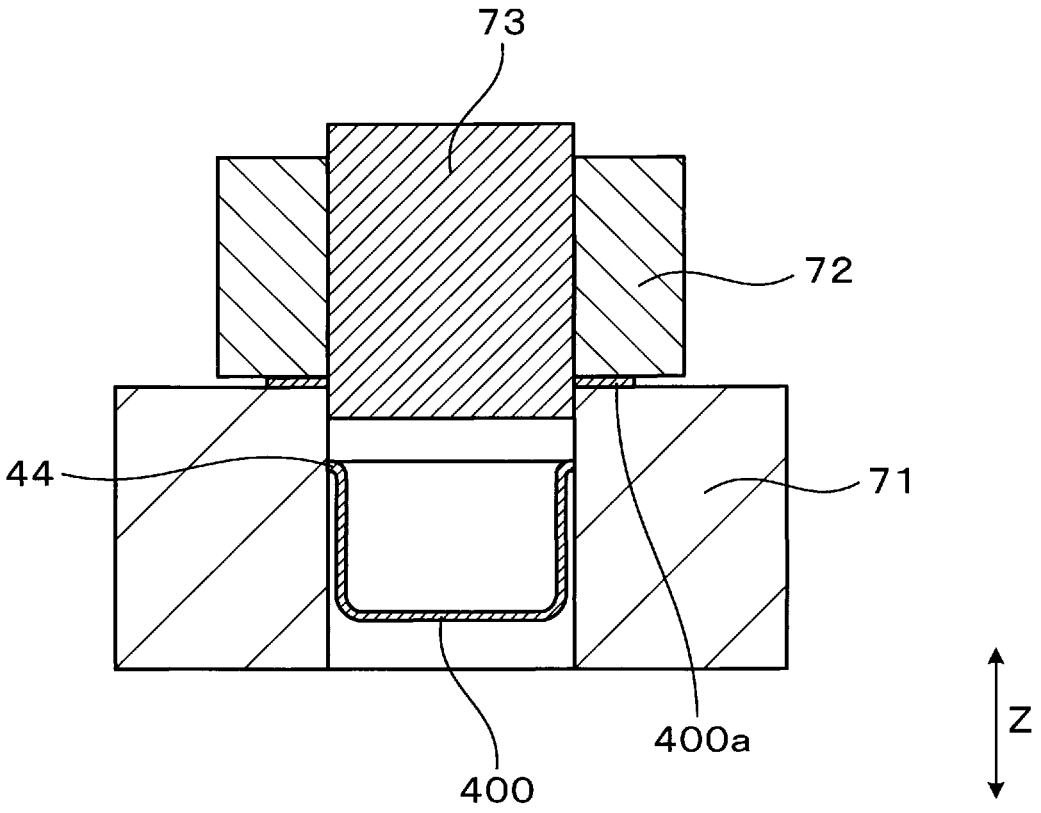
FIG. 18 is a sectional view which illustrates a cup with an end after being cut out in the fifth embodiment.
Figure 19:
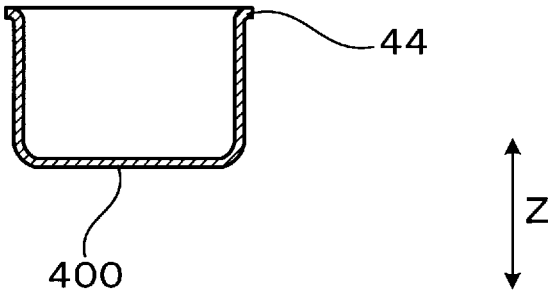
FIG. 19 is a sectional view which illustrates a high-voltage terminal formed to have a flange in the fifth embodiment.

Subsequently, the edge 400*a* of the cup 400 is, as illustrated in FIGS. 17 and 18, firmly grasped between the die 71 and the holder 72 in the vertical direction Z. The punch 73 disposed in the holder 72 is, as illustrated in FIG. 18, forced in the vertical direction Z to cut out the cup 400 with the flange 44 illustrated in FIG. 19.

Other arrangements are identical with those in the first embodiment.

As apparent from the above discussion, in the production process of the high-voltage terminal 4, the punch 6 use in the drawing process and the punch 73 used in the die-cutting process are both moved in the same direction (i.e., the vertical direction Z) to complete the high-voltage terminal 4, thus improving the productivity of the ignition coil 1.

The flange 44 is shaped to protrude into the resinous cylinder 3, thereby minimizing a risk that the high-voltage terminal 4 is undesirably removed upward or downward from the resinous cylinder 3.

The fifth embodiment offers substantially the same beneficial advantages as those in the first embodiment.

Sixth Embodiment

FIGS. 20 to 23 illustrate the ignition coil 1 according to the sixth embodiment which is different in configuration of the resinous cylinder 3 from the first embodiment.

Figure 20:
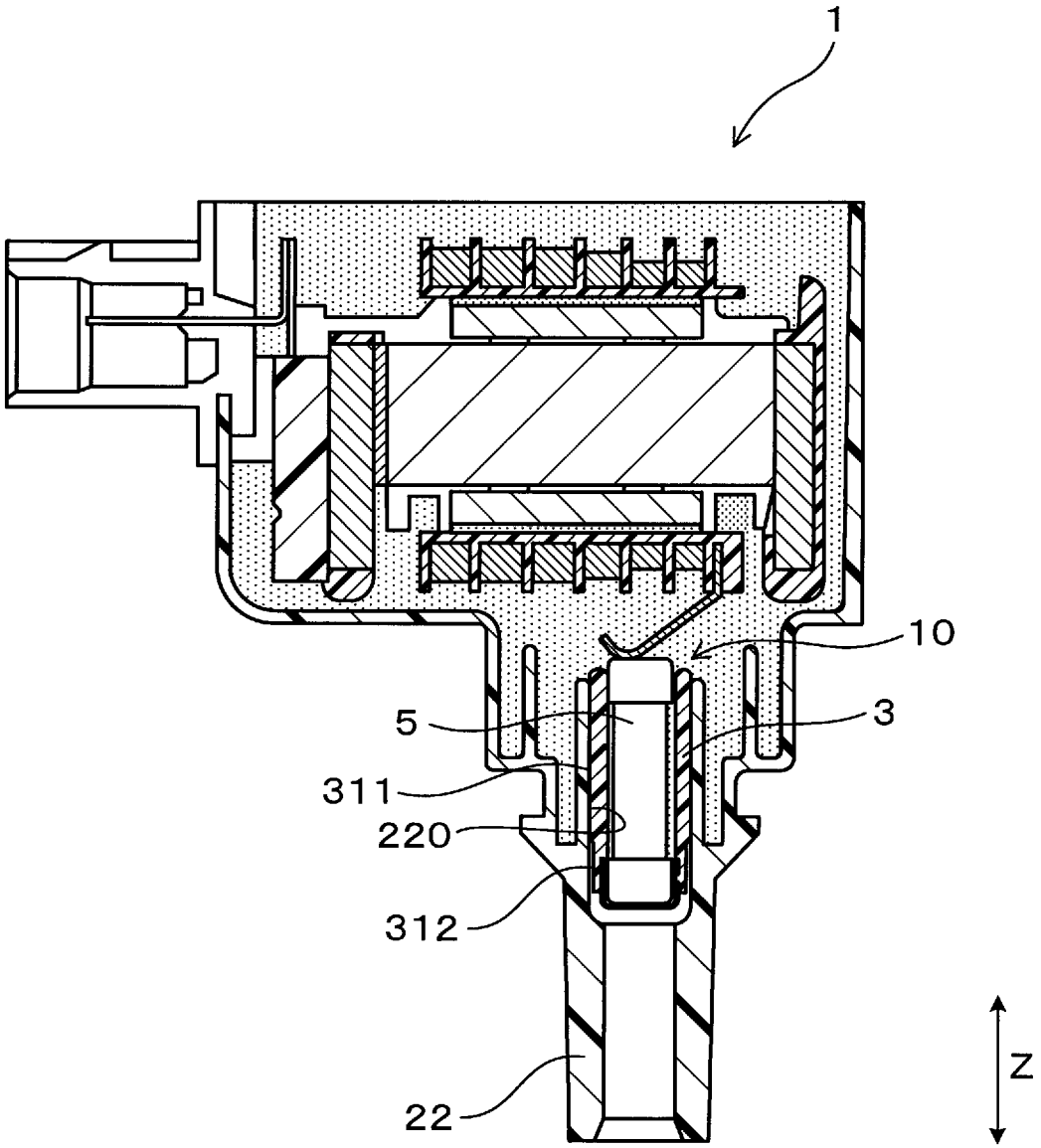
FIG. 20 is a sectional view which illustrates an ignition coil for internal combustion engines according to the sixth embodiment.
Figure 21:
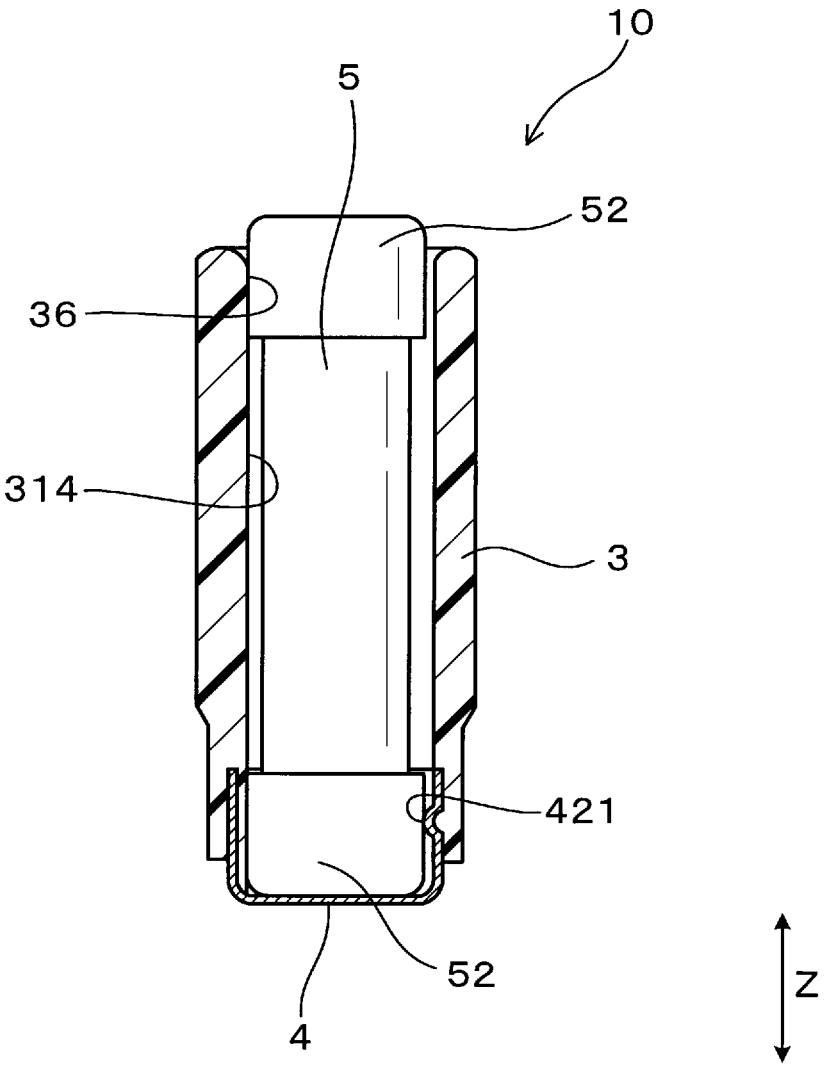
FIG. 21 is a partially sectional view which illustrates a closing member in the sixth embodiment.

Specifically, the resinous cylinder 3, as clearly illustrated in FIGS. 20 and 21, has an upper end located substantially at the same level as that of an upper end of the resistor 5 in the vertical direction Z. More specifically, the upper end of the resinous cylinder 3 is located slightly below the upper end of the resistor 5 in the vertical direction Z.

The upper end of the resinous cylinder 3, as can be seen in FIG. 20, slightly protrudes upward from the upper end of the high-hole 220 of the high-voltage tower 22. In other words, a portion of the resinous cylinder 3 which protrudes upward from the through-hole 220 of the high-voltage tower 22 constitutes a portion of the outer non-pressed surface 312. A portion of the resinous cylinder 3 between the portion of the resinous cylinder 3 which protrudes upward from the through-hole 220 of the high-voltage tower 22 and the tapered outer surface 313 defines the outer pressure surface 311 pressed against to the high-voltage tower 22. The length of the outer pressure surface 311 is greater than that of the outer non-pressed surface 312 in the vertical direction Z. Specifically, the length of the outer pressure surface 311 is set greater than or equal to half that of the resistor 5 in the vertical direction Z.

Figure 22:
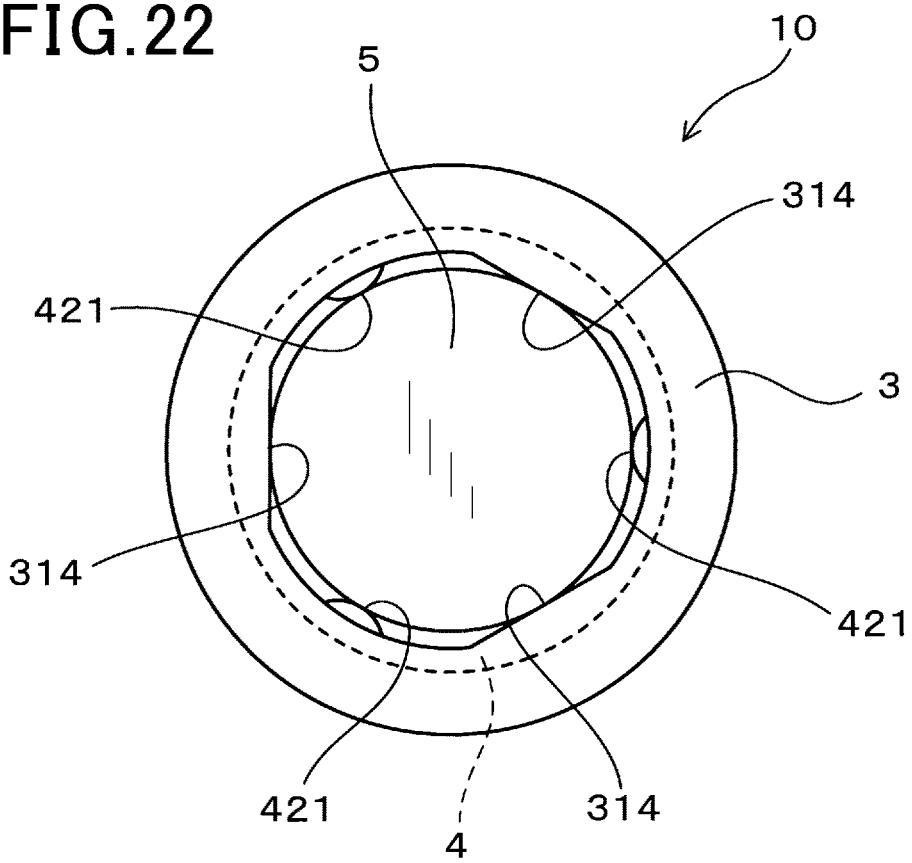
FIG. 22 is a plan view which illustrates a closing member in the sixth embodiment.
Figure 23:
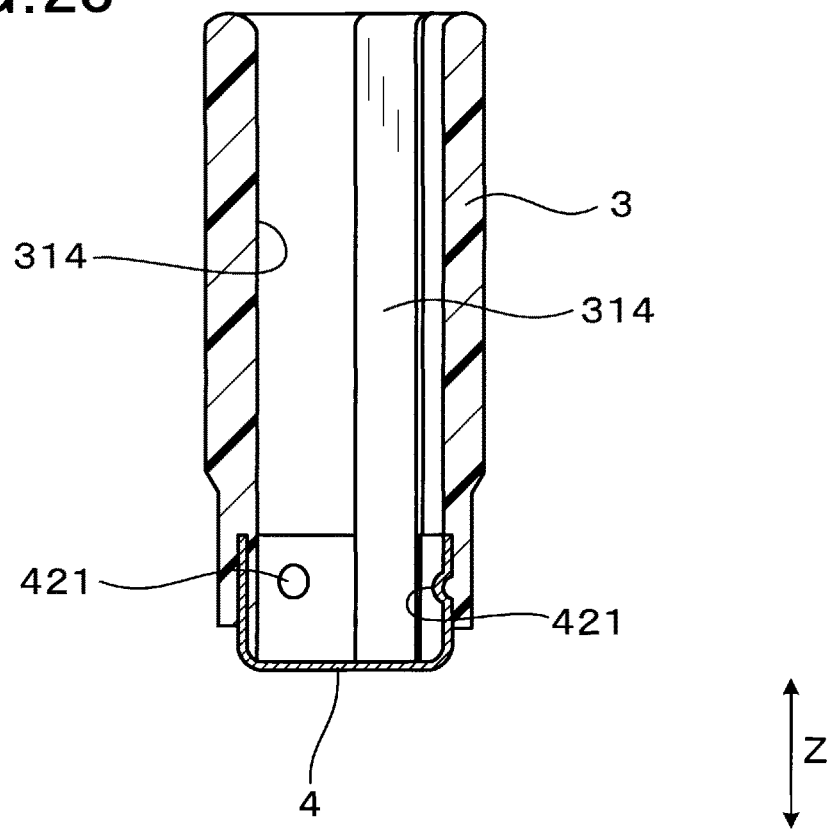
FIG. 23 is a sectional view which illustrates a resinous cylinder and a high-voltage terminal in the sixth embodiment.

The resinous cylinder 3, as illustrated in FIGS. 21 to 23, has the positioning portions 314 formed on the inner periphery thereof. Each of the positioning portions 314, as can be seen in FIG. 22, protrudes inwardly in the form of a flat wall. The positioning portions 314 work to position the resistor 5 relative to the resinous cylinder 3 in the radial direction thereof.

Each of the positioning portions 314, as can be seen in FIGS. 21 and 23, occupies an entire dimension of the resinous cylinder 3 in the vertical direction Z. Each of the positioning portions 314 of the resinous cylinder 3 has a lower end protruding downward from the remaining portion of the resinous cylinder 3. A portion of the resinous cylinder 3 which includes the positioning portions 314 is shaped to have the high-voltage terminal 4 embedded therein. In other words, the high-voltage terminal 4 is formed to have a portion of the resinous cylinder 3 which includes the positioning portions 314 and is embedded therein.

Each of the positioning portions 314, as clearly illustrated in FIG. 22, has a flat surface extending in a direction perpendicular to the radial direction of the resinous cylinder 3. Each of the positioning portions 314 has an upper end rounded to extend upward and outward in the radial direction of the resinous cylinder 3 in order to facilitate insertion of the resistor 5 into the resinous cylinder 3.

The positioning portions 314 are, as can be seen in FIG. 22, located at three places at equal intervals away from each other in the circumferential direction of the resinous cylinder 3. Each of the positioning portions 314 is offset from one of the inner protrusions 421 in the circumferential direction of the resinous cylinder 3. The three positioning portions 314 and the three inner protrusions 421 are arranged alternately in the circumferential direction. In other words, each of the positioning portions 314 is located adjacent two of the inner protrusions 421 in the circumferential direction of the resinous cylinder 3. All the positioning portions 314 and all the inner protrusions 421 are disposed at equal intervals away from each other in the circumferential direction of the resinous cylinder 3.

Each of the positioning portions 314, as illustrated in FIG. 21, extends along or in contact with outer peripheral surfaces of the upper and lower electrode caps 52 of the resistor 5. In other words, the resinous cylinder 3 has the resinous upper inner end walls 36 which extend along or in contact with the outer peripheral surface of an upper portion of the resistor 5. Specifically, the positioning portions 314 have upper end sections which form the upper inner end walls 36. Each of the positioning portions 314 is not press-fit on the resistor 5. Each of the positioning portions 314 may be disposed either in contact or in non-contact with the resistor 5. When placed in non-contact with the resistor 5, the positioning portions 314 are disposed close to the resistor 5 to position the resistor 5 relative to the resinous cylinder 3 in the radial direction of the resistor 5.

The resistor 5 is, like in the above embodiments, covered substantially fully with the filled resin 15 in the circumferential direction thereof. The material of the filled resin 15 is injected around the resistor 5 through a gap, as illustrated in FIG. 22, between the resinous cylinder 3 and the resistor 5.

Other arrangements are identical with those in the first embodiment.

The resinous cylinder 3, as described above, has the upper inner end walls 36 which extend along or in contact with the outer peripheral surface of the upper portion of the resistor 5. This minimizes a risk that the upper end of the resistor 5 is undesirably moved relative to the resinous cylinder 3. The resinous cylinder 3 has the upper inner end walls 36 formed at three or more places located away from each other in the circumferential direction thereof, thereby ensuring the stability in minimizing the movement of the resistor 5 relative to the resinous cylinder 3.

The outer pressure surface 311 is formed to be longer than the outer non-pressed surface 312 in the vertical direction Z, thereby improving the contact or adhesion between the resinous cylinder 3 and the high-voltage tower 22 to enhance sealing therebetween.

The sixth embodiment offers substantially the same beneficial advantages as those in the first embodiment.

Seventh Embodiment

Figure 24:
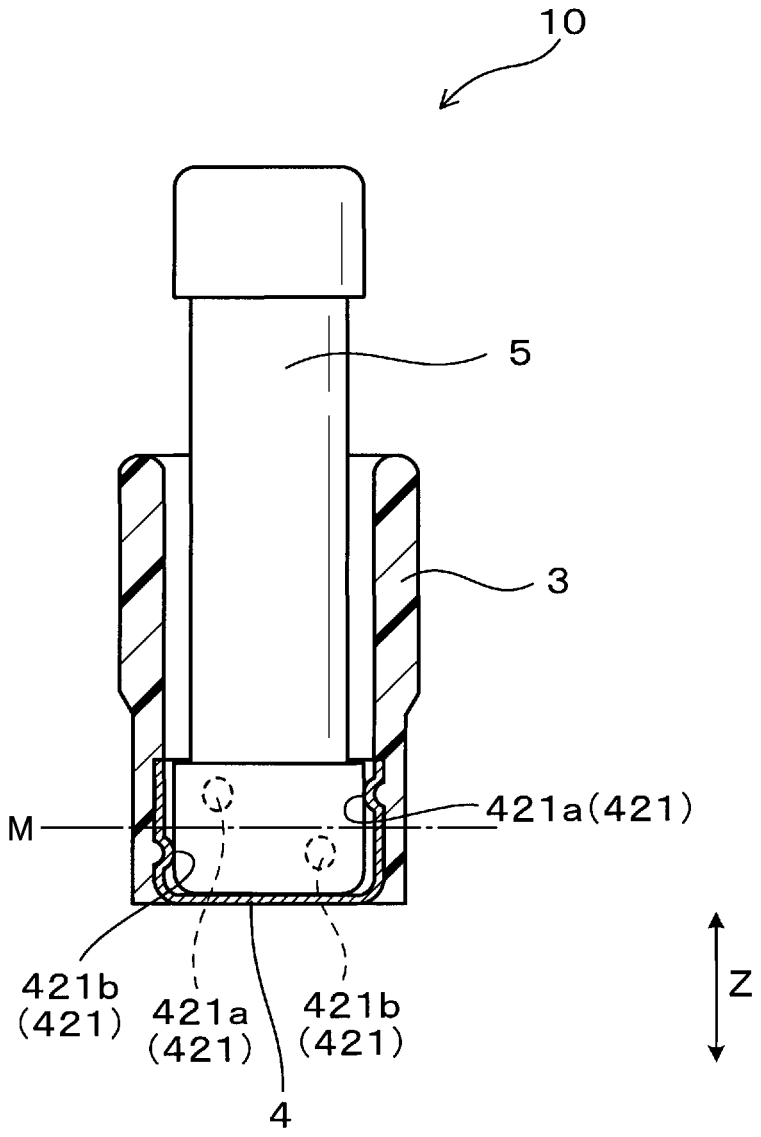
FIG. 24 is a partially sectional view which illustrates a closing member in the seventh embodiment.

FIG. 24 illustrates the closing member 10 according to the seventh embodiment which has a plurality of inner protrusions 421 offset from each other in the vertical direction Z.

Figure 25:
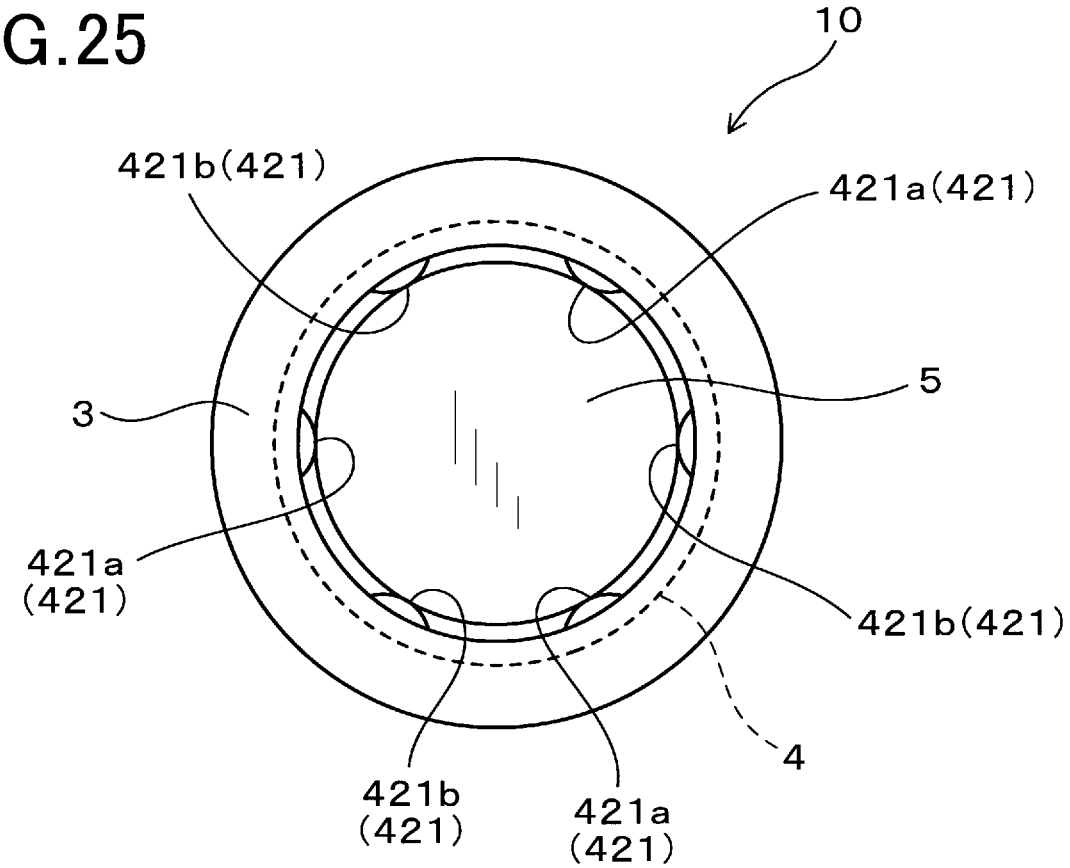
FIG. 25 is a plan view which illustrates a closing member in the seventh embodiment.

Specifically, the high-voltage terminal 4, as illustrated in FIG. 25, has the six inner protrusions 421 which are arranged at equal intervals away from each other in the circumferential direction of the high-voltage terminal 4. The high-voltage terminal 4 of this embodiment, as clearly illustrated in FIG. 24, has two arrays: an upper and a lower array of the inner protrusions 421. Specifically, the upper array includes the three inner protrusions 421 which will also be referred to below as upper inner protrusions 421*a*. The lower array includes the three inner protrusions 421 which will also be referred to below as lower inner protrusions 421*b*. The upper and lower arrays are arranged away from each other in the vertical direction Z.

The upper inner protrusions 421*a* and the lower inner protrusions 421*b* are, as clearly illustrated in FIGS. 24 and 25, arranged alternately in the circumferential direction of the high-voltage terminal 4. The upper inner protrusions 421*a* are, as can be seen in FIG. 24, disposed on the upper side of the center line M, while the lower inner protrusions 421*b* are disposed on the lower side of the center line M. The center line M is defined to extend in a direction perpendicular to the vertical direction Z and pass through the middle of the high-voltage terminal 4 between an upper and a lower end opposed to each other in the vertical direction Z.

The resinous cylinder 3 is arranged to have the lower end lying at the same level as that of the lower end of the high-voltage terminal 4 in the vertical direction Z.

Other arrangements are identical with those in the first embodiment.

The high-voltage terminal 4 of this embodiment is, as described above, equipped with a plurality of arrays of the inner protrusions 421 which are arranged away from each other in the vertical direction Z, thereby minimizing undesirable movement of the resistor 5 relative to the high-voltage terminal 4. In other words, the high-voltage terminal 4 firmly holds the resistor 5 at a plurality of points located away from each other in the vertical direction Z, thereby ensuring the stability of securement of the resistor 5 to the high-voltage terminal 4.

Other arrangements are identical with those in the first embodiment.

Eighth Embodiment

Figure 26:
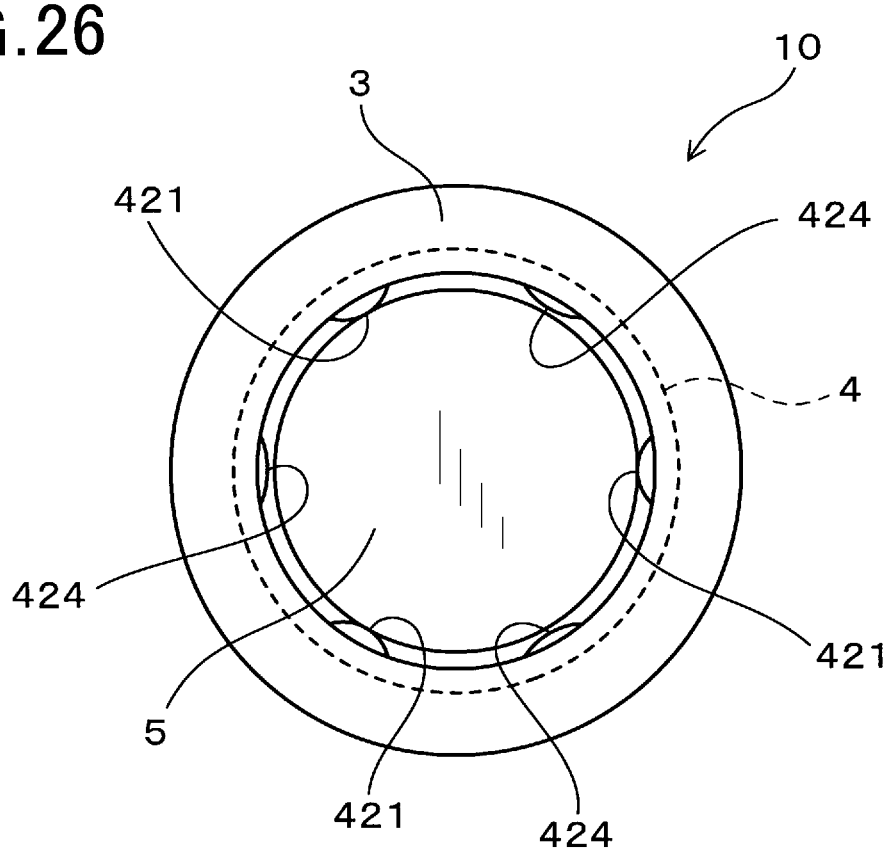
FIG. 26 is a plan view which illustrates a closing member in the eighth embodiment.

FIG. 26 illustrates the closing member 10 according to the eighth embodiment.

The high-voltage terminal 4 has the non-contact protrusions 424 formed on the inner peripheral surface thereof. The non-contact protrusions 424 bulge inward in the radial direction of the high-voltage terminal 4 and are placed in non-contact with the outer periphery of the resistor 5.

Figure 27:
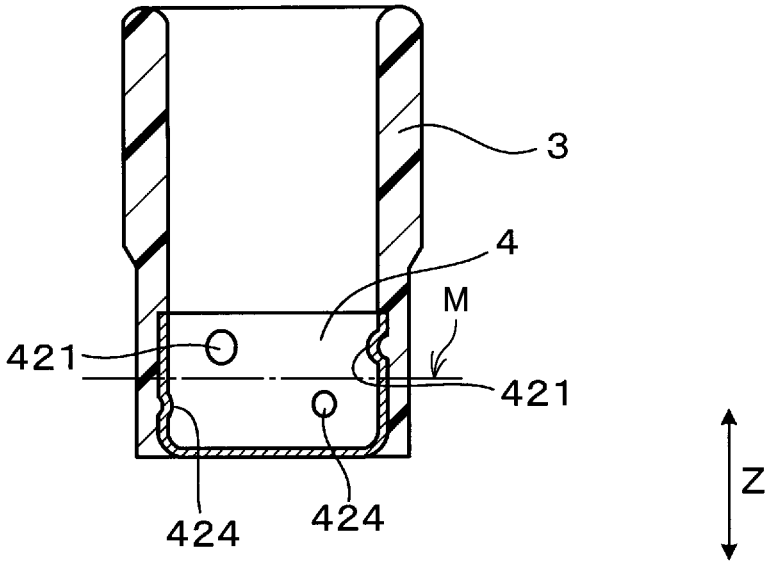
FIG. 27 is a sectional view which illustrates a resinous cylinder and a high-voltage terminal in the eighth embodiment.

The non-contact protrusions 424 are, as can be seen in FIG. 27, offset from at least one of the inner protrusions 421 in the vertical direction Z.

The non-contact protrusions 424 are, as can be seen in FIG. 26, arranged at three places at equal intervals away from each other in the circumferential direction of the high-voltage terminal 4. All the non-contact protrusions 424 are offset from all the inner protrusions 421 in the circumferential direction. The non-contact protrusions 424 and the inner protrusions 421 are arranged alternately in the circumferential direction. All the non-contact protrusions 424 and all the inner protrusions 421 are located at equal intervals away from each other in the circumferential direction of the high-voltage terminal 4.

The inner protrusions 421 are, as illustrated in FIG. 27, arranged above the center line M of the high-voltage terminal 4 in the vertical direction Z. The center line M is defined in the same way as discussed in FIG. 24. The inner protrusions 421 are all located at the same level in the vertical direction Z. In other words, the inner protrusions 421 are all aligned with each other in the circumferential direction of the high-voltage terminal 4.

The non-contact protrusions 424 are, as illustrated in FIG. 27, all arranged below the center line Min the vertical direction Z. The non-contact protrusions 424 are all located at the same level in the vertical direction Z. In other words, the non-contact protrusions 424 are all aligned with each other in the circumferential direction of the high-voltage terminal 4.

The non-contact protrusions 424 are, as can be seen in FIGS. 26 and 27, similar in shape to the inner protrusions 421, but however, a degree to which the non-contact protrusions 424 bulge in the radial direction of the high-voltage terminal 4 is less than that to which the inner protrusions 421 bulge in the radial direction of the high-voltage terminal 4. In other words, the non-contact protrusions 424 have apexes located outside an inscribed circle of the inner protrusions 421 in the radial direction of the high-voltage terminal 4.

The resinous cylinder 3 is, like in the seventh embodiment, arranged to have the lower end lying at the same level as that of the lower end of the high-voltage terminal 4 in the vertical direction Z.

Other arrangements are identical with those in the first embodiment.

The high-voltage terminal 4 of this embodiment is, as described above, equipped with the non-contact protrusions 424 which bulge inward and are located away from the outer periphery of the resistor 5. The non-contact protrusions 424 are offset from at least one of the inner protrusions 421 in the vertical direction Z. The non-contact protrusions 424 serve to achieve physical interference of the outer periphery of the resistor 5 with the non-contact protrusions 424 when the resistor 5 is tilted relative to the high-voltage terminal 4, thereby minimizing such tilt of the resistor 5.

The eighth embodiment offers substantially the same beneficial advantages as those in the first embodiment.

Ninth Embodiment

Figure 28:
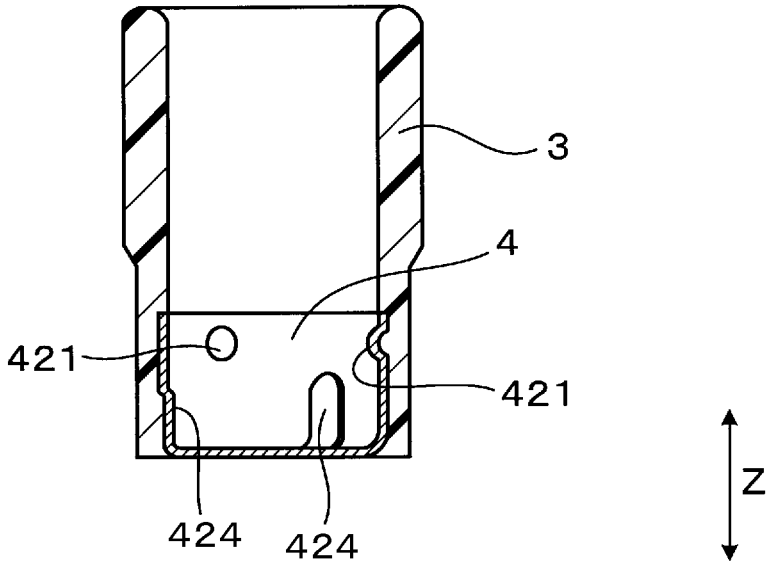
FIG. 28 is a sectional view which illustrates a resinous cylinder and a high-voltage terminal in the ninth embodiment.

FIG. 28 illustrates high-voltage terminal 4 according to the ninth embodiment which is different in configuration of the non-contact protrusions 424 from the eighth embodiment.

Specifically, each of the non-contact protrusions 424 is formed in an elongated shape and bulges inward from the inner periphery of the high-voltage terminal 4. Each of the non-contact portions 424 has a length extending in the vertical direction Z. More specifically, each of the non-contact protrusions 424 extends from the circular bottom wall 41 of the high-voltage terminal 4 to substantially the middle of the high-voltage terminal 4 in the vertical direction Z.

Other arrangements are identical with those in the eighth embodiment.

The ninth embodiment offers substantially the same beneficial advantages as those in the eighth embodiment.

Tenth Embodiment

Figure 29:
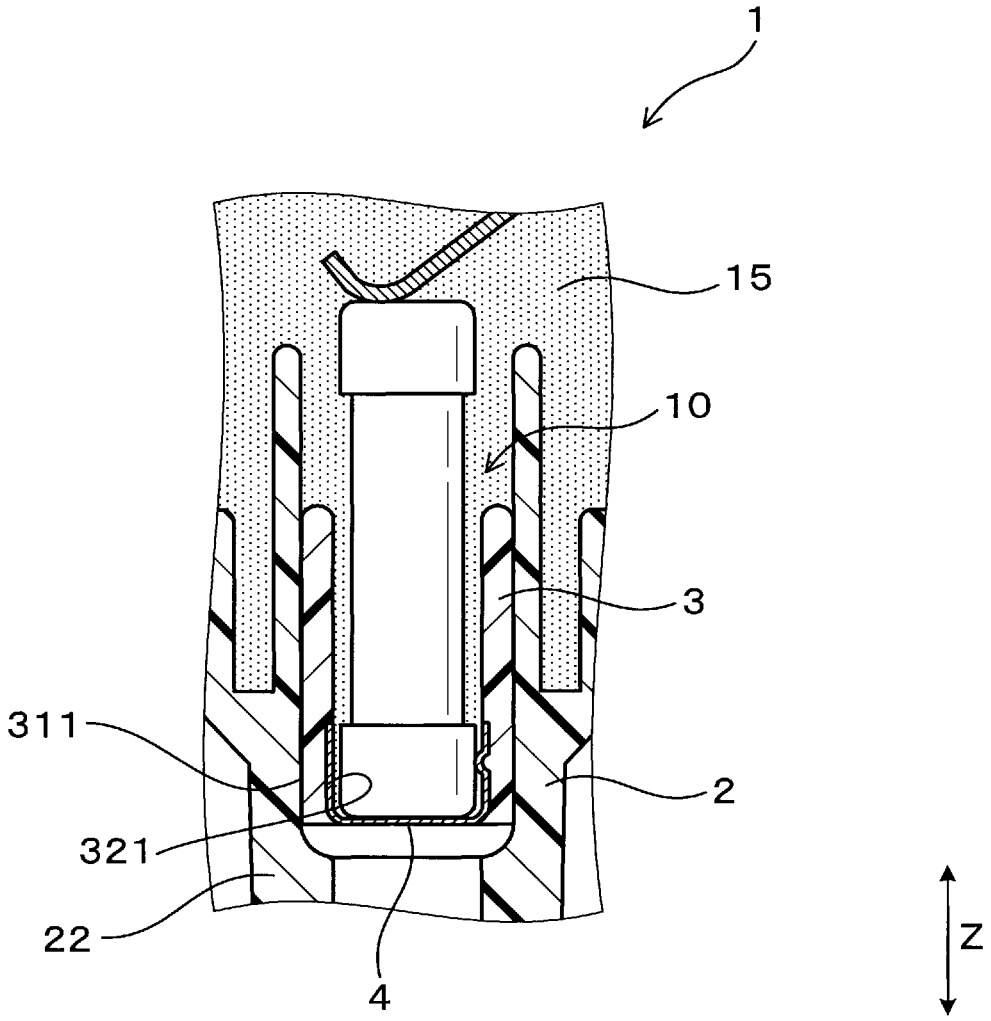
FIG. 29 is an enlarged sectional view which illustrates a region around a resistor of an ignition coil for internal combustion engine according to the tenth embodiment.

FIG. 29 illustrates the ignition coil 1 according to the tenth embodiment which is different in configuration of the resinous cylinder 3 from the first embodiment.

Specifically, the resinous cylinder 3 is shaped to have a substantially entire outer peripheral surface pressed against the high-voltage tower 22. In other words the entire outer peripheral surface of the resinous cylinder 3 constitutes the outer pressure surface 311.

The high-voltage terminal 4 is firmly attached to an inner peripheral surface of an end portion (i.e., a lower end portion) of the resinous cylinder 3 which is opposed to the outer pressure surface 311 through a thickness of the resinous cylinder 3. The inner peripheral surface of the lower end portion of the resinous cylinder 3 opposed to the outer pressure surface 311 has the large-diameter inner surface 321 to which the outer peripheral surface of the high-voltage terminal 4 is, as described above, firmly attached.

The resinous cylinder 3 is arranged to have a lower end (i.e., a bottom end) coinciding with a lower end of the high-voltage terminal 4 in the vertical direction Z.

Other arrangements are identical with those in the first embodiment.

The ignition coil 1 of this embodiment offers the substantially same beneficial advantages as those in the first embodiment except that provided by the location of the high-voltage terminal 4 inside an area of the resinous cylinder 3 which extends in the vertical direction Z and is occupied by the outer non-pressed surface 312 (see FIG. 2).

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

For instance, the resinous cylinder 3 in the first embodiment has the outer pressure surface 311 located above the outer non-pressed surface 312, but however, it may be formed below the outer non-pressed surface 312 in the vertical direction Z. In the first to ninth embodiments, the outer non-pressed surface 312 has the upper end portion shaped as the tapered outer surface 313 which has a diameter increasing upward, but however, it may be shaped to have an upper end extending in a direction perpendicular to the vertical direction Z. In other words, the resinous cylinder 3 may be designed to have a shoulder which lies between the lower end of the outer pressure surface 311 and the outer non-pressed surface 312 and extends substantially perpendicular to the vertical direction Z. In this case, the high-voltage tower 22 may have formed on the inner periphery thereof an inner shoulder which is contactable with the shoulder of the resinous cylinder 3 in the vertical direction Z, thereby minimizing a variation in location of the resinous cylinder 3 relative to the high-voltage tower 22 in the vertical direction Z. The upper portion of the outer non-pressed surface 312 may alternatively be curved.

What is claimed is:

1. An ignition coil for an internal combustion engine comprising:

a primary coil and a secondary coil which are magnetically coupled with each other;

a case which includes a case body in which the primary and secondary coils are disposed and a high-voltage tower which is of a hollow cylindrical shape and extends downward from the case body;

a closing member which is press-fit in the high-voltage tower to close an inside of the high-voltage tower; and a filled resin which is disposed inside the case body and hermetically seals the primary and secondary coils, wherein the closing member includes a resinous cylinder, a high-voltage terminal, and a resistor, the high-voltage terminal being firmly attached to the resinous cylinder and of a hollow cylindrical shape with a bottom and an upper opening facing upward, the resistor being disposed inside the high-voltage tower, and wherein the closing member is pressed at an outer peripheral surface of the resinous cylinder against the high-voltage tower.

2. An ignition coil for an internal combustion engine as set forth in claim 1, wherein the outer peripheral surface of the resinous cylinder includes an outer pressure surface and an outer non-pressed surface which are arranged adjacent each other in a vertical direction of the ignition coil, the outer pressure surface being placed in pressed contact with the high-voltage tower, the outer non-pressed surface being not pressed against the high-voltage tower, and wherein the high-voltage terminal is located inside a portion of the resinous cylinder which has the outer non-pressed surface in a direction substantially perpendicular to the vertical direction.

3. An ignition coil for an internal combustion engine as set forth in claim 1, wherein the high-voltage terminal has formed on an inner peripheral surface thereof inner protrusions which bulge inward and are placed in contact with the outer peripheral surface of the resistor.

4. An ignition coil for an internal combustion engine as set forth in claim 3, wherein the inner protrusions are located at a plurality of places on the inner peripheral surface of the high-voltage terminal and arranged in the vertical direction.

5. An ignition coil for an internal combustion engine as set forth in claim 3, wherein the high-voltage terminal has formed on the inner peripheral surface thereof non-contact protrusions which bulge inward and are placed in non-contact with the outer peripheral surface of the resistor, and wherein the non-contact protrusions are offset from at least one of the inner protrusions in the vertical direction.

6. An ignition coil for an internal combustion engine as set forth in claim 1, wherein in a region extending in the vertical direction where the high-voltage terminal and the resinous cylinder are firmly attached to each other, the high-voltage terminal has at least one of an outer protrusion, an outer recess, and a hole, the outer protrusion being formed on the outer peripheral surface of the high-voltage terminal and bulging outward into the inner peripheral surface of the resinous cylinder in a radial direction thereof, the outer recess being formed in the outer peripheral surface of the high-voltage terminal and having a portion of the resinous cylinder disposed therein, the hole passing through the high-voltage terminal in a radial direction of the high-voltage terminal and having a portion of the resinous cylinder disposed therein.

7. An ignition coil for an internal combustion engine as set forth in claim 1, wherein the resinous cylinder has an upper inner end wall extending along an outer peripheral surface of an upper portion of the resistor.

8. An ignition coil for an internal combustion engine as set forth in claim 1, wherein the high-voltage terminal has formed on an upper end thereof, a flange which extends outward.

9. An ignition coil for an internal combustion engine as set forth in claim 1, wherein the outer peripheral surface of the resinous cylinder includes an outer pressure surface and an outer non-pressed surface which are arranged adjacent each other in a vertical direction of the ignition coil, the outer pressure surface being placed in pressed contact with the high-voltage tower, the outer non-pressed surface being not pressed against the high-voltage tower.

10. An ignition coil for an internal combustion engine as set forth in claim 1, wherein the resinous cylinder partially lies between the high-voltage terminal and the high-voltage tower.

* * * * *